US012702265B2

(12) United States Patent
Lee et al.

(10) Patent No.: US 12,702,265 B2
(45) **Date of Patent: *Aug. 11, 2026**

(54) DISH WASHER

(71) Applicant: LG Electronics Inc., Seoul (KR)

(72) Inventors: Sang Soo Lee, Seoul (KR); Hoseok Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/947,626

(22) Filed: Nov. 14, 2024

(65) Prior Publication Data

US 2025/0064290 A1 Feb. 27, 2025

Related U.S. Application Data

(63) Continuation of application No. 17/864,043, filed on Jul. 13, 2022, now Pat. No. 12,171,388.

(30) Foreign Application Priority Data

Jul. 13, 2021 (KR) ..... 10-2021-0091678

(51) Int. Cl.

| | |
|---|---|
| ***A47L 15/00*** | (2006.01) |
| ***A47L 15/42*** | (2006.01) |
| ***A47L 15/48*** | (2006.01) |

(52) U.S. Cl.

CPC ..... *A47L 15/0034* (2013.01); *A47L 15/4257* (2013.01); *A47L 15/4287* (2013.01); *A47L 15/486* (2013.01); *A47L 2401/20* (2013.01); *A47L 2401/26* (2013.01); *A47L 2501/26* (2013.01)

(58) Field of Classification Search

None

See application file for complete search history.

(56) References Cited

U.S. PATENT DOCUMENTS

| | | | |
|---|---|---|---|
| 2019/0104916 | A1 | 4/2019 | Kim et al. |
| 2022/0104685 | A1 | 4/2022 | Wolowicz et al. |

FOREIGN PATENT DOCUMENTS

| | | |
|---|---|---|
| DE | 10122182 | 11/2002 |
| DE | 10-2013-204003 | 9/2014 |
| EP | 3263005 | 1/2018 |
| EP | 3654820 | 6/2021 |
| KR | 10-2021-0066413 | 6/2021 |

OTHER PUBLICATIONS

Extended European Search Report in European Appln No. 22184592.8, dated Dec. 13, 2022, 9 pages.

*Primary Examiner* — Rita P Adhlakha

(74) *Attorney, Agent, or Firm* — Fish & Richardson P.C.

(57) ABSTRACT

A dish washer includes: a tub configured to receive an object to be washed and providing a washing space having an opening at a front side of the tub, a door configured to rotate relative to the tub between (i) a closing position that closes the opening of the washing space and (ii) a full opening position that exposes an entirety of the opening of the washing space, a door position sensor configured to sense a position of the door, a dry air supply configured to selectively generate a high-temperature dry air or a low-temperature dry air and supply the high-temperature dry air or the low-temperature dry air into the tub, and a controller configured to determine, based on the position of the door sensed by the door position sensor, whether to supply the high-temperature dry air or the low-temperature dry air.

20 Claims, 23 Drawing Sheets

DISH WASHER

CROSS-REFERENCE TO RELATED APPLICATION

This application is a continuation of U.S. patent application Ser. No. 17/864,043, filed on Jul. 13, 2022, which claims priority to and the benefit of Korean Patent Application No. 10-2021-0091678, filed on Jul. 13, 2021, the disclosure of which is incorporated herein by reference in its entirety.

TECHNICAL FIELD

The present disclosure relates to a dish washer, and more particularly, to a dish washer that enhances the drying performance and efficiency and reduces a drying time by optimizing a degree to which a door is opened where the opening of the door receives a high-temperature dry air, and reduces a probability of user's scald and burn and improves safety by immediately stopping the supply of the high-temperature dry air when the door is opened to an additional degree during the supply of the high-temperature dry air, switching to a low-temperature dry air supply mode, and generating a high-temperature risk alarm to a user.

BACKGROUND

A dish washer is a device that washes an object accommodated therein to be washed, such as tableware or cooking equipment by spraying wash water such as water thereon. In this case, the wash water being used for washing may include a dish detergent.

A conventional dish washer may include a tub that forms a washing space, an accommodation part that accommodates an object to be washed in the tub, a spray arm that sprays the washing water into the accommodation part, and a sump that stores water and supplies the washing water to the spray arm.

By using the conventional dish washer, it is possible to reduce time and effort to wash the object to be washed, such as tableware, after meal, thereby contributing to user convenience.

Typically, the dish washer is configured to perform a washing process to wash the object to be washed, a rinsing process to rinse the object to be washed, and a drying process to dry the object to be washed, of which the washing and rinsing have been completed.

Recently, a dish washer that can reduce a dry time and improve a sterilization effect of the object to be washed by supplying high-temperature dry air into the tub during the drying process has been introduced.

The dish washer can be configured to supply high-temperature dry air in a state where a door is opened at least partly before the high-temperature dry air is supplied after washing and rinsing processes are completed.

According to the door of the dish washer, the door is automatically or manually opened at least partly before the high-temperature dry air is supplied, and after the door is opened at least partly, the high-temperature dry air is supplied.

However, the dish washer fails to disclose a degree to which a door is opened to start supplying the high-temperature dry air.

Accordingly, if the door is opened to more than the degree to which the door is open, the supplied high-temperature dry air is not evenly distributed inside the tub, and the object to be washed is not likely to be dried smoothly. Further, if the door is opened to less than the degree to which the door is open, the air having an increased moisture after the object to be washed is dried is not smoothly discharged to the outside, and the humidity inside the tub is highly likely to be maintained significantly high, and thus time for the dry process is highly likely to be excessively increased.

Further, the dish washer is unable to sense an additional opening of the door during the supply of the high-temperature dry air, and thus blocking of the supply of the high-temperature dry air cannot be provided.

For example, even in a case where a user opens the door in a state where the door is opened during the supplying of the high-temperature dry air regardless of user's intention or the user does not recognize the supplying of the high-temperature dry air, the high-temperature dry air has is continuously supplied into the tub.

Accordingly, in the case where the door is opened, the user may be directly exposed to the supplied high-temperature dry air, or may be in direct contact with the object to be washed that is in the high-temperature state, and such exposure and contact may cause the user to suffer scald.

Another conventional dish washer improves the drying efficiency and performance by automatically changing a program for performing a drying process in response to a degree of an opening or opening deviation of a door.

However, the conventional dish washer is configured to start a drying process in a state where the door is opened, but fails to protect a user while the drying process using a high-temperature dry air is performed. For example, even in a case where the door is opened at a sufficient degree for a user to access an inside of a tub, the high-temperature dry air may be continuously supplied, and, thus, causing scald to the user.

SUMMARY

The present disclosure is directed to a dish washer that enhances the drying performance and efficiency and reduces a drying time by optimizing a degree to which a door is opened for receiving a first temperature dry air.

The present disclosure is also directed to a dish washer that reduces a probability of a user suffering scald and burn and improves safety by immediately stopping the supply of the first temperature dry air in a case where the door is opened to an additional degree during the supply of the first temperature dry air, and generating a first temperature risk alarm to a user.

The present disclosure is also directed to a dish washer that reduces a probability of a user suffering scald by immediately lowering the temperature of an object to be washed through stopping of an operation of a heater that generates a first temperature dry air and continuously supplying of a second temperature dry air through a blower fan when the door is opened to an additional degree during supplying of the first temperature dry air.

The present disclosure is also directed to a dish washer effectively reducing an inner moisture condensation phenomenon by stopping operations of a heater and a blower fan for generating a first temperature dry air when a door is closed during supplying of the first temperature dry air.

Aspects of the disclosure are not limited to the above-described aspects, and unmentioned other aspects and advantages of the disclosure will be understood through the following description, and will be understood more clearly by embodiments of the disclosure. Further, it will be easy to know that the aspects and advantages of the disclosure can be realized by means represented in the claims and a combination thereof.

According to one aspect of the subject matter described in this application, a dish washer can include a tub configured to receive an object to be washed and providing a washing space having an opening at a front side of the tub, a door configured to rotate relative to the tub between (i) a closing position that closes the opening of the washing space and (ii) a full opening position that exposes an entirety of the opening of the washing space, a door position sensor configured to sense a position of the door, a dry air supply configured to selectively generate a first temperature dry air or a second temperature dry air and supply the first temperature dry air or the second temperature dry air into the tub, the first temperature dry air having a higher air temperature than the second temperature dry air, and a controller configured to determine, based on the position of the door sensed by the door position sensor, whether to supply the first temperature dry air or the second temperature dry air.

Implementations according to this aspect can include one or more of the following features. For example, the dish washer can further include an automatic door opener configured to move the door from the closing position to a middle stop position set between the closing position and the full opening position to expose a part of the opening of the washing space. The controller can be configured to operate the automatic door opener before supplying the first temperature dry air or the second temperature dry air.

In some implementations, the dish washer can further include an elastic member configured to provide a restoring force to rotate the door toward the closing position. The middle stop position can be a position at which a rotating force generated by a weight of the door and an elastic force of the elastic member are equal to each other. In some implementations, the controller can be configured to receive an output signal from the door position sensor and determine the position of the door through the received output signal after operating the automatic door opener, and start supplying the first temperature dry air by supplying power to the dry air supply based on a determination that the door moves from the closing position and the part of the washing space is exposed.

In some examples, the dry air supply can include a blower fan configured to generate a dry air flow to be supplied into the tub, a blower motor configured to generate a rotational force of the blower fan, and a heater configured to heat the dry air flow. The controller can be configured to, based on a determination to supply the first temperature dry air, supply the power to the blower fan and the heater, and, based on a determination to supply the second temperature dry air, supply the power to the blower fan and block the power from being supplied to the heater. In some examples, the controller can be configured to determine whether the door reaches a predetermined risk area start position set between the middle stop position and the full opening position based on the output signal of the door position sensor after supplying the first temperature dry air.

In some implementations, the controller can include a timer configured to measure an elapsed time after the automatic door opener is operated. The controller can be configured to, based on a determination that the door does not reach the predetermined risk area start position, determine whether the elapsed time exceeds a predefined first temperature dry time. In some examples, the controller can be configured to, based on a determination that the elapsed time is greater than or equal to the predefined first temperature dry time, switch an operation of the dry air supply from supplying the first temperature dry air to supplying the second temperature dry air.

In some examples, the controller can be configured to, after the operation of the dry air supply is switched, determine whether the elapsed time exceeds a predefined set time. In some examples, the controller can be configured to, based on a determination that the elapsed time is greater than or equal to the predefined set time, stop the operation of the dry air supply.

In some implementations, the dry air supply can further include a temperature sensor configured to measure a temperature of the dry air. The controller can be configured to, based on a determination that the elapsed time is less than the predefined first temperature dry time, (i) receive the output signal from the temperature sensor and (ii) determine whether the temperature of the dry air in the received output signal exceeds a predefined temperature. In some examples, the controller can be configured to, based on a determination that the temperature of the dry air is greater than or equal to the predefined temperature, switch the operation of the dry air supply from supplying the first temperature dry air to supplying the second temperature dry air.

In some implementations, the dish washer can further include at least one of a speaker configured to generate a sound alarm or a display configured to generate a visual alarm. The controller can be configured to, based on a determination that the door reaches the predetermined risk area start position, generate an acoustic or visual warning alarm through the speaker or the display. The warning alarm can include information regarding a risk from the first temperature dry air. In some examples, after the warning alarm is generated, the controller can be configured to update and store a number of times of the warning alarm is generated, and determine whether the updated number exceeds a predefined number.

In some examples, the controller can be configured to, based on a determination that the updated number exceeds the predefined number, (i) stop an additional warning alarm generation and (ii) switch the operation of the dry air supply from supplying the first temperature dry air to supplying the second temperature dry air, after the additional warning alarm generation is stopped. In some examples, the controller can include a timer configured to measure an elapsed time after the automatic door opener is operated. The controller can be configured to determine whether the elapsed time exceeds a predefined set time after switching the operation of the dry air supply, and stop, based on a determination that the elapsed time is greater than or equal to the predefined time, the operation of the dry air supply.

In some implementations, the controller can be configured to, based on a determination that the door does not move from the closing position, maintain a non-operation state of the dry air supply. In some examples, the dish washer can further include at least one of a speaker configured to generate a sound alarm or a display configured to generate a visual alarm. The controller can be configured to, based on a determination that the door does not move from the closing position, generate an acoustic or visual error alarm through the speaker or the display. The error alarm can include information regarding the dry air supply being inoperable.

In some examples, the controller can include a timer configured to measure an elapsed time after the automatic door opener is operated. The controller can be configured to determine whether the elapsed time exceeds a predefined set time after the error alarm is generated. In some examples, the controller can be configured to, based on a determination that the elapsed time is greater than or equal to the predefined set time, generate acoustic or visual completion alarm through the speaker or the display. The completion alarm can include information regarding operation status of the dry air supply.

The dish washer can enhance the drying performance and efficiency and can reduce a drying time by optimizing a degree to which a door is opened for receiving a high-temperature dry air.

Further, the dish washer can include a door sensing sensor capable of effectively sensing whether a door is opened to an additional degree during supplying of a high-temperature dry air, and thus can reduce a probability of a user suffering scald and improve safety by immediately stopping the supply of the high-temperature dry air when the door is opened to the additional degree while the high-temperature dry air is supplied and generating a high-temperature risk alarm for a user.

Further, the dish washer can effectively reduce a probability of a user suffering scald by immediately lowering the temperature of an object to be washed through stopping of an operation of a heater that generates a high-temperature dry air and continuously supplying a low-temperature dry air through a blower fan when a door is opened to an additional degree during supplying of the high-temperature dry air.

Further, the dish washer can effectively reduce an inner moisture condensation phenomenon by stopping operations of a heater and a blower fan for generating a high-temperature dry air when a door is closed during supplying of the high-temperature dry air.

In addition to the above-described effects, specific effects of the disclosure will be hereinafter described together with specific matters for implementing the disclosure.

DETAILED DESCRIPTION

Figure 1:
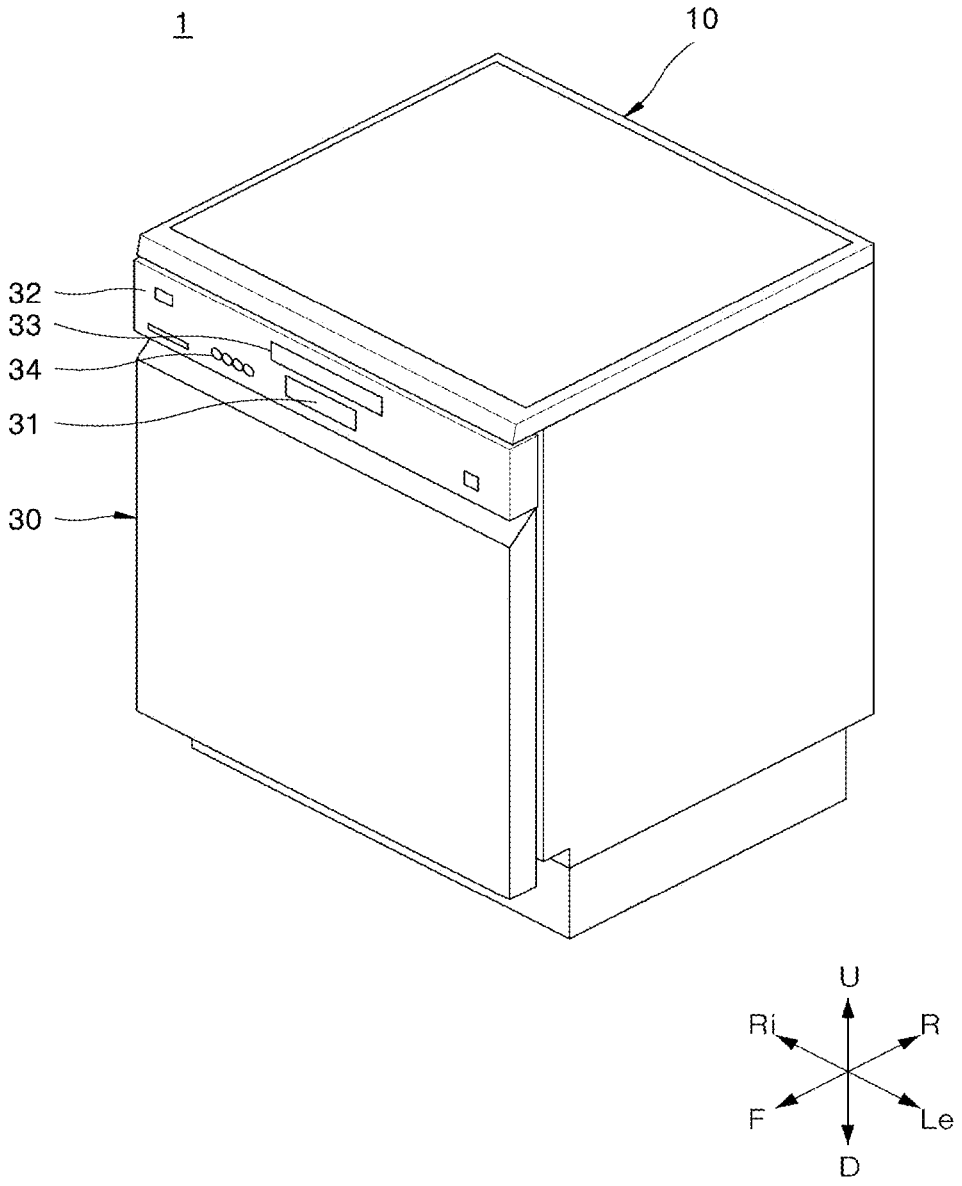
FIG. 1 is a diagram illustrating an example of a dish washer.
Figure 2:
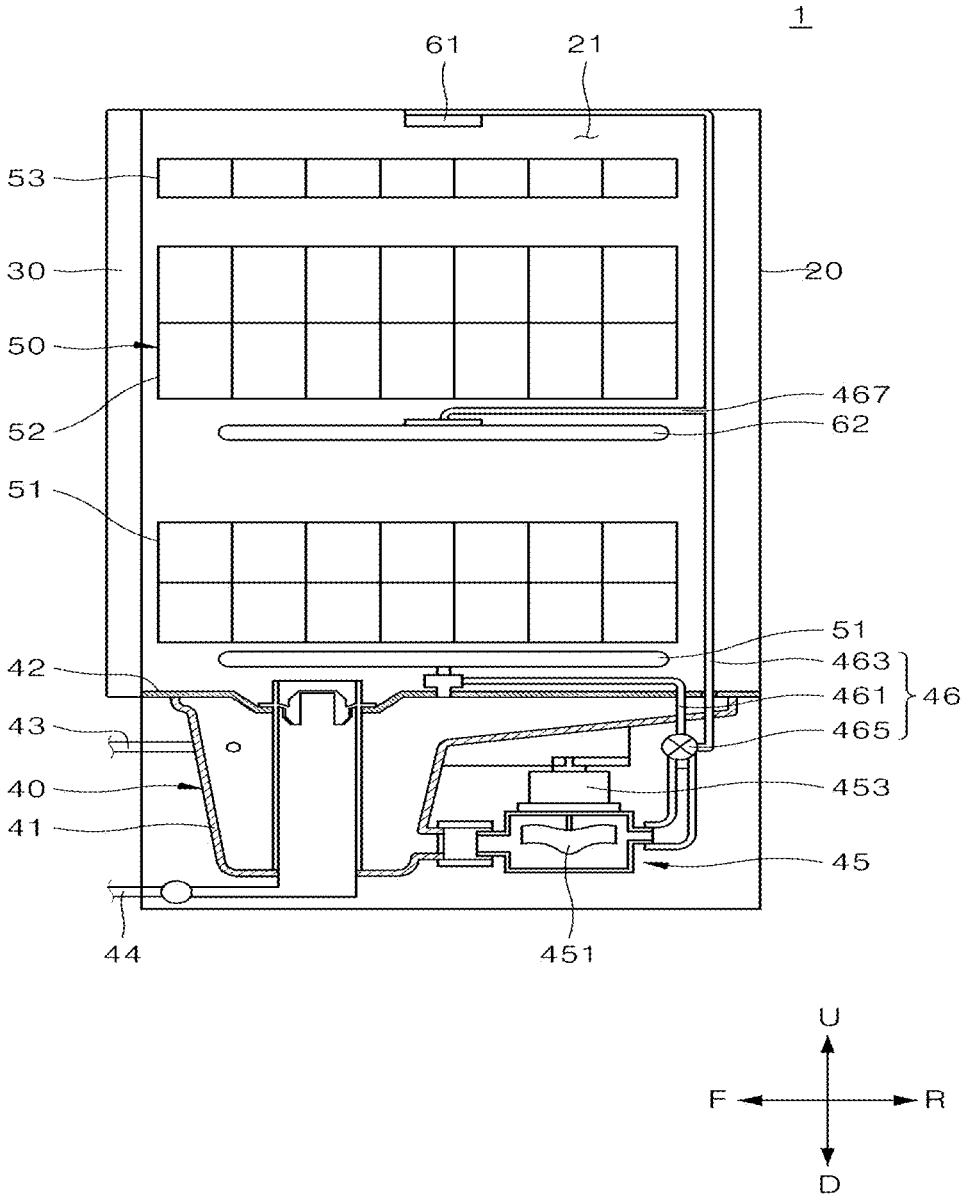
FIG. 2 is a diagram illustrating a schematic cross-sectional view of the example of the dish washer illustrated in FIG. 1.

FIG. 1 is a diagram illustrating an example of a dish washer 1, and FIG. 2 is a diagram illustrating a schematic cross-sectional view of the example of the dish washer 1 illustrated in FIG. 1.

As illustrated in FIGS. 1 and 2, the dish washer 1 can include a case 10 configured to define an external appearance, a tub 20 installed inside the case 10, providing a washing space 21 in which an object to be washed is washed, and having an opening at a front side, a door 30 configured to open/close the opening of the tub 20, a drive part 40 disposed at a lower part of the tub 20 and configured to supply, collect, circulate, and drain washing water for washing the object to be washed, an accommodation part 50 detachably provided in the washing space 21 inside the tub 20 and in which the object to be washed is received, and a spray part 60 installed adjacent to the accommodation part 50 and configured to spray the washing water for washing the object to be washed.

In some implementations, the object to be washed, which is seated in the accommodation part 50 can be, for example, tableware, such as a bowl, dish, spoon, and chopsticks, and other cookware.

The tub 20 can have a shape of a box having an opening that defines the entire front side.

The washing space 21 can be provided inside the tub 20, and the opening of the washing space 21 can be opened or closed by the door 30.

The tub 20 can be made of a metal plate that is resistant to high temperature and moisture, for example, a plate of a stainless steel material.

Further, on an inner side surface of the tub 20, a plurality of brackets can be disposed for supporting and installing functional configurations, such as the accommodation part 50 and the spray part 60 to be described later, inside the tub 20.

In some implementations, the drive part 40 can be configured to include a sump 41 configured to store the washing water, a sump cover 42 configured to divide the sump 41 and the tub 20 from each other, a water supply part 43 configured to supply the washing water from an outside of the drive part 40 to the sump 41, a drainage part 44 configured to discharge the washing water in the sump 41 to an outside of the sump 41, a water supply pump 45 configured to supply the washing water of the sump 41 to the spray part 60, and a supply flow path 46.

The sump cover 42 can be disposed at an upper side of the sump 41, and can divide the tub 20 and the sump 41 from each other. Further, the sump cover 42 can include a plurality of recovery holes for recovering the washing water, which is sprayed into the washing space 21 through the spray part 60, to the sump 41.

For example, the washing water sprayed from the spray part 60 toward the tableware can be received in the washing space 21, and can be recovered back to the sump 41 through the sump cover 42.

The water supply pump 45 can be provided on a side part or a lower part of the sump 41, and can supply the washing water to the spray part 60 by pressing the washing water.

One end of the water supply pump 45 can be connected to the sump 41, and the other end of the water supply pump 45 can be connected to the supply flow path 46. Inside the water supply pump 45, an impeller 451 and a motor 453 can be provided. If power is supplied to the motor 453, the impeller 451 can be rotated, and the washing water of the sump 41 can be pressed and then supplied to the spray part 60 through the supply flow path 46.

In some implementations, the supply flow path 46 can selectively supply the washing water supplied from the water supply pump 45 to the spray part 60.

For example, the supply flow path 46 can include a first supply flow path 461 connected to a lower spray arm 61, and a second supply flow path 463 connected to an upper spray arm 62 and a top nozzle 63, and, on the supply flow path 46, a supply flow path switching valve 465 configured to selectively open or close the first and second supply flow paths 461 and 463 can be provided.

In some implementations, the supply flow path switching valve 465 can control the respective first and second supply flow paths 461 and 463 to be opened sequentially or simultaneously.

In some implementations, the spray part 60 can be configured to spray the washing water onto the tableware accommodated in the accommodation part 50.

For example, the spray part 60 can include a lower spray arm 61 positioned on the lower part of the tub 20 and configured to spray the washing water to a lower rack 51, an upper spray arm 62 positioned between the lower rack 51 and an upper rack 52 and configured to spray the washing water to the lower rack 51 and the upper rack 52, and a top nozzle 63 positioned on the upper part of the tub 20 and configured to spray the washing water to a top rack 53 or the upper rack 52.

For example, the lower spray arm 61 and the upper spray arm 62 can be provided in the washing space 21 of the tub 20 and can be rotated to spray the washing water toward the tableware in the accommodation part 50.

The lower spray arm 61 can be rotatably provided at an upper side of the sump cover 42 so as to be rotated to spray the washing water from the lower part of the lower rack 51 toward the lower rack 51.

Further, the upper spray arm 62 can be rotatably provided by a spray arm holder 467 so as to be rotated to spray the washing water between the lower rack 51 and the upper rack 52.

In some implementations, to increase washing efficiency, on a lower surface of the tub 20, a reflective plate that switches the washing water sprayed from the lower spray arm 61 in an upward direction (U-direction) can be further provided.

In some implementations, in the washing space 21, the accommodation part 50 for accommodating the tableware can be provided.

The accommodation part 50 can be configured to be drawn from the inside of the tub 20 through the opening at the front side of the tub 20.

For example, FIG. 2 illustrates that the accommodation part 50 includes the lower rack 51 positioned on the lower part of the tub 20 and configured to accommodate relatively large-sized tableware, the upper rack 52 positioned on the upper side of the lower rack 51 and configured to accommodate middle-sized tableware, and the top rack 53 positioned on the upper part of the tub 20 and configured to accommodate small-sized tableware. The disclosure is not limited thereto, but as illustrated, explanation will be made based on an implementation of the dish washer 1 provided with three racks 51, 52, and 53 of the accommodation part 50.

The lower rack 51, the upper rack 52, and the top rack 53 can be configured to be drawn to the outside of the tub 20 after passing through the opening at the front side of the tub 20.

Figure 3:
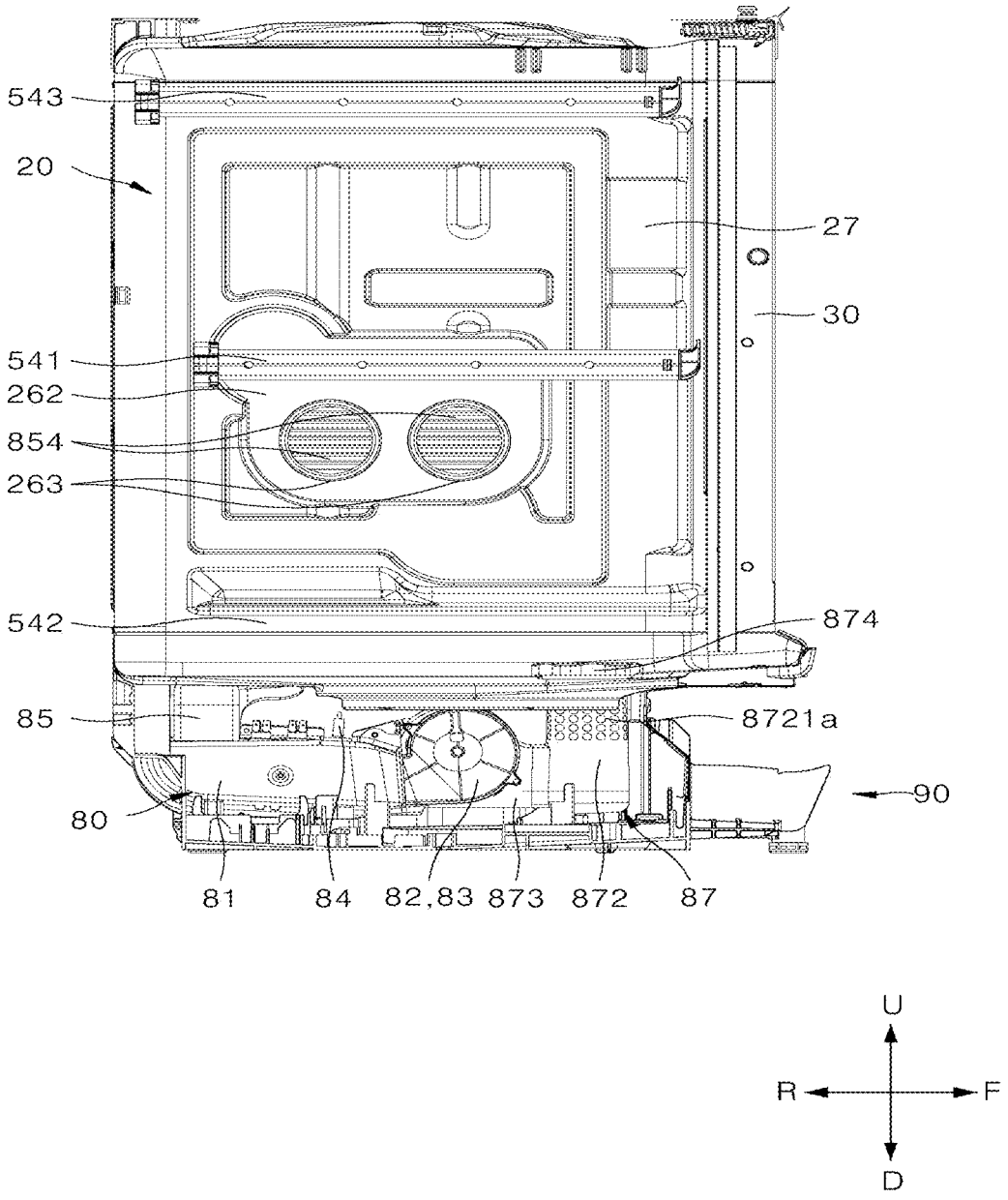
FIG. 3 is a diagram illustrating a detailed cross-sectional view of the example of the dish washer illustrated in FIG. 1.

In some implementations, at both side walls defining an inner periphery of the tub 20, a guide rail 54 can be provided, and, for example, the guide rail 54 can include an upper rail 541, a lower rail 542, and a top rail 543 (see FIG. 3).

On the respective lower parts of the lower rack 51, the upper rack 52, and the top rack 53, wheels can be provided. A user may draw the lower rack 51, the upper rack 52, and the top rack 53 to the outside through the front of the tub 20, and thus can accommodate the tableware therein, or can easily draw the tableware of which the washing is completed therefrom.

The guide rail 54 can be provided as a simple rail type fixed guide rail for guiding draw-out and draw-in of the spray part 60 or an expansion guide rail guiding draw-out and accommodation of the spray part 60 and of which the draw-out distance is increased in accordance with the draw-out of the spray part 60.

In some implementations, the door 30 can be configured to open and close the above-described opening at the front side of the tub 20.

A hinge part configured to open and close the door 30 can be provided at the lower part of the opening at the front side of the tub 20, and the door 30 can be opened with respect to the hinge part as a rotation axis.

In some implementations, on the outer side surface of the door 30, a handle 31 for opening the door 30 and a control panel 32 for controlling the dish washer 1 can be provided (see FIG. 1).

As illustrated in FIG. 1, the control panel 32 can be provided with a display 33 for visually displaying information regarding the current operation status of the dish washer 1, and a button part 34 including a selection button for inputting a user's selection operation and a power button for inputting a user's operation for turning on/off the power of the dish washer.

In some implementations, the inner side surface of the door 30 can provide a seating surface defining one surface of the tub 20 when the door 30 is closed and supporting the lower rack 51 of the accommodation part 50 when the door 30 is opened.

In some implementations, the inner side surface of the door 30 can provide a horizontal surface that corresponds to a direction in which the guide rail 54 for guiding the lower rack 51 is extended when the door 30 is fully opened.

In some implementations, on the lower part of the tub 20, a dry air supply part for generating and supplying high-temperature dry air to the inside of the tub 20 can be provided. On at least one of the right side surface or the left side surface of the tub 20, at least one dry air supply hole can be provided to introduce the high-temperature dry air generated by the dry air supply part into the inside of the tub.

Hereinafter, with reference to FIGS. 3, 4, and 5, the detailed description of the dry air supply part 80 will be discussed.

Figure 4:
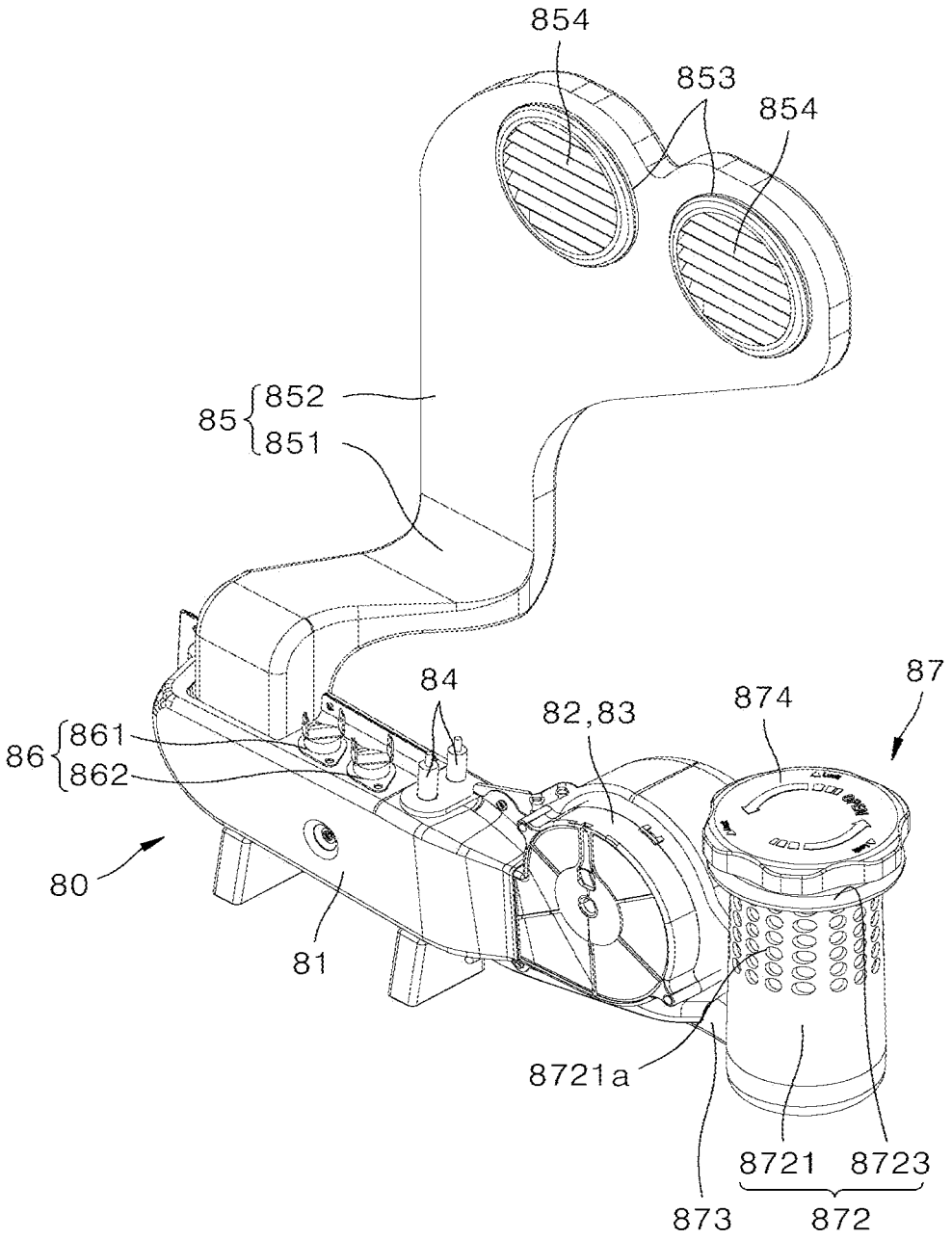
FIG. 4 is a diagram illustrating a perspective view of an example of a dry air supply part illustrated in FIG. 3.
Figure 5:
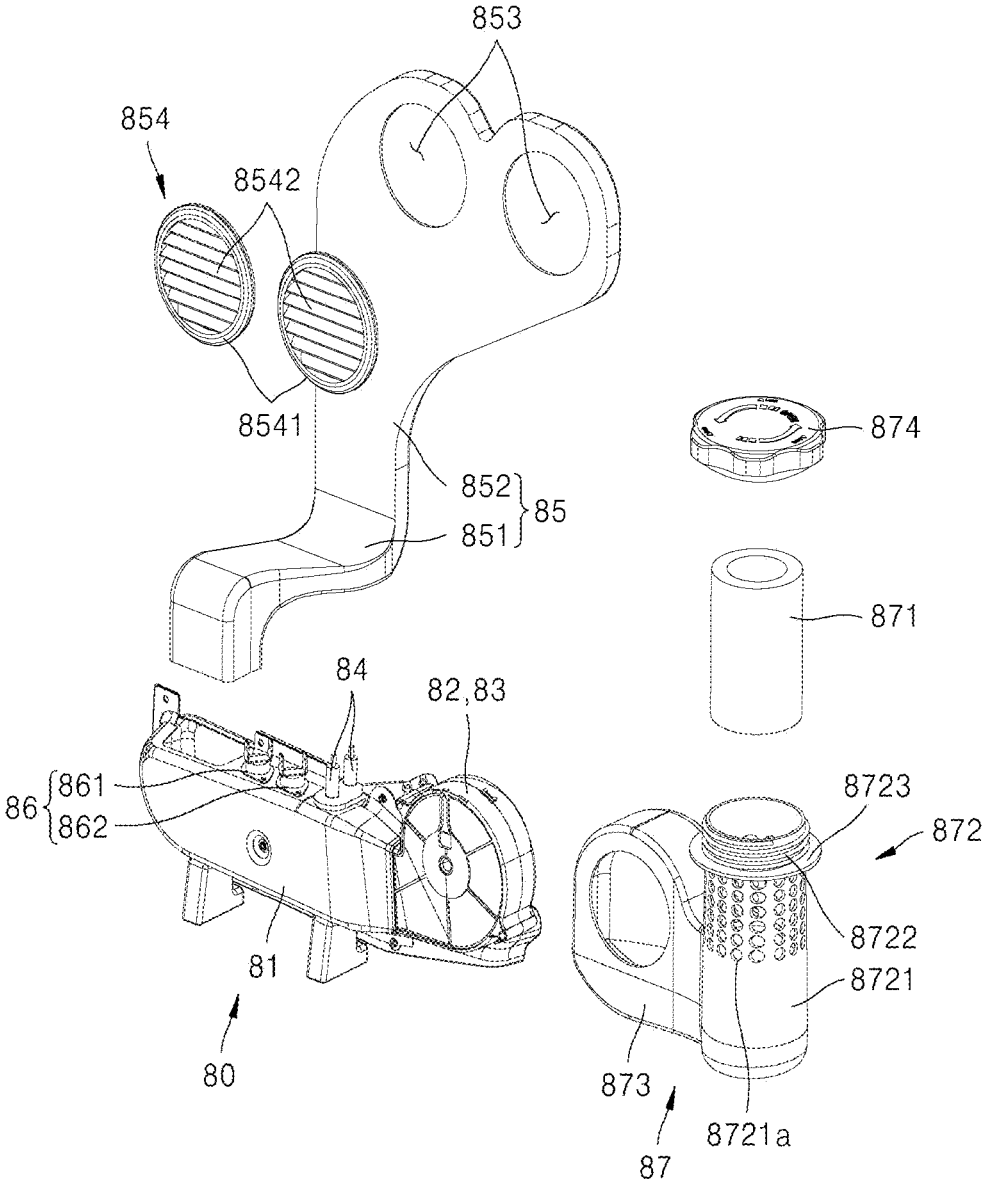
FIG. 5 is a diagram illustrating an exploded perspective view of the example of the dry air supply part illustrated in FIG. 4.

Referring to FIGS. 3, 4, and 5, the dry air supply part 80 that generates and supplies dry air to the inside of the tub 20 can include a blower fan 82 that generates a dry air flow toward the inside of the tub 20, a blower motor 83 that generates a rotational driving force of the blower fan 82, a heater 84 that heats the dry air, and a heater housing 81 in which an air path is provided.

The blower fan 82 can be disposed at an upstream side in a direction of the dry air flow at an entrance side of the heater housing 81, and can be configured to generate the dry air flow by accelerating the air into the air path provided inside the heater housing 81.

The blower motor 83 that generates the rotational driving force of the blower fan 82 can be modularized and combined with the blower fan 82.

The type of the blower fan 82 being applied to the dry air supply part 80 is not limited, but for example, a sirocco fan can be provided in consideration of positional restrictions and spatial restrictions on installation of the blower fan 82.

In some implementations, in a case where the sirocco fan is provided as the blower fan 82, an external air can be suctioned in a direction parallel to the rotational axis from the center of the sirocco fan, and the air can be accelerated and discharged toward the outside in a radius direction. The accelerated and discharged air can provide the dry air flow, and can be introduced into the air path inside the heater housing 81.

The heater 84 can be disposed in the air path of the heater housing 81, can be directly exposed to the dry air flow inside the air path, and can be configured to heat air moving in the dry air flow.

In some implementations, in a case where the dry air supply part 80 supplies the high-temperature dry air, the heater 84 can be configured to be supplied with the power and to heat the dry air, and, in a case where the dry air supply part 80 supplies a low-temperature dry air, the power to the heater 84 can be blocked, and the heater 84 can be configured to stop its operation.

In some implementations, in a case where the low-temperature dry air is supplied, the operation of the blower motor 83 can be maintained to generate the dry air flow.

The type of the heater 84 provided in the dry air supply part 80 may not limited, but for example, a sheath heater having a relatively simple structure and having excellent heat efficiency can be provided.

In some implementations, to enhance the heat exchange efficiency, the heater 84 can be configured to be directly exposed to the dry air flow in the air path inside the heater housing 81 and to have a three-dimensional shape that bends multiple times to secure a heat transfer area.

In some implementations, as illustrated in FIGS. 4 and 5, at the upper side surface of the heater housing 81, a temperature sensor 86 can be provided as a temperature sensing part for sensing whether the temperature of the high-temperature dry air is generated through the heater 84 or for sensing whether the heater 84 is overheated.

For example, the temperature sensor 86 can include a thermistor 861 for sensing the temperature of the dry air and a thermostat 862 for sensing whether the heater 84 is overheated.

In some implementations, an output signal of the temperature sensor 86 can be transferred to a controller 100, and the controller 100 can receive the output signal of the temperature sensor 86, and can determine the temperature of the high-temperature dry air and whether the heater 84 is overheated or not. When the overheating occurs, the controller 100 can switch the operation mode of the dry air supply part 80 from a high-temperature dry air supply mode to a low-temperature dry air supply mode by blocking the power supply to the heater 84.

In some implementations, the heater housing 81 can be provided with an entrance and an exit communicating with the air path provided inside the heater housing 81. An exit of the blower fan 82 can be connected to the entrance side of the heater housing 81, and a blower duct 85 can be connected to the exit side of the heater housing 81.

The heater housing 81 can be made of a material that can be tolerant to a high-temperature environment generated through the heater 84 and that is a lightweight metal material.

In some implementations, the heater housing 81 and the blower fan 82 can be disposed on the lower side of the lower surface of the tub 20 and can be accommodated in and coupled to a base 90.

In some implementations, the dry air supply part 80 can further include a blower duct 85 that is combined with the exit side of the heater housing 81 and in which an air path is provided.

As described above, the heater housing 81 and the blower fan 82 can disposed at the lower side of the lower surface of the tub 20. The blower duct 85 can be configured to guide the dry air discharged from the heater housing 81 so that the dry air can move toward a predetermined position.

For example, the predetermined position can be a left side surface 26 of the tub 20 (see FIG. 7), and a dry air supply hole 263 can be provided in the left side surface 26 of the tub 20, onto which the dry air flow guided to the blower duct 85 is introduced.

In some implementations the dry air supply hole 263 is provided on the left side surface 26 of the tub 20, but the disclosure is not limited thereto. For example, the dry air supply hole 263 can be provided at a position that is not the left side surface 26 of the tub 20, and can be provided at the right side surface or the lower surface of the tub 20. Explanation will be exemplarily made based on the implementation in which the dry air supply hole 263 is provided at the left side surface 26 of the tub 20.

In some implementations, the blower duct 85 can have a shape capable of connecting the dry air supply hole 263 provided at the left side surface 26 of the tub 20 to the exit of the heater housing 81.

For example, the blower duct 85 can include a first duct 851 having one end communicating with the exit of the heater housing 81 and the other end extending in a horizontal direction, and a second duct 852 having one end communicating with the other end of the first duct 851 and the other end extending in a vertical direction toward the dry air supply hole 263.

In some implementations, to improve the supply efficiency of the dry air, as illustrated, a plurality of dry air supply holes 263 can be provided, and in response to the plurality of dry air supply holes 263, a plurality of discharge holes 853 of the blower duct 85 can be provided.

Hole caps 854 can be combined with the discharge holes 853 of the blower duct 85 and the dry air supply holes 263. In some implementations, in response to a case where the discharge hole 853 and the dry air supply hole 263 are provided as circular openings, the hole cap 854 can be provided in a ring shape.

For example, the hole cap 854 can include a ring-shaped cap body 8541 and a plurality of vanes 8542 extending across the inside of the cap body 8541.

The plurality of vanes 8542 can switch the discharge direction of the dry air discharged from the dry air supply holes 263, and can reduce an inflow of the washing water inside the tub 20 to the blower duct 85 after passing through the dry air supply holes 263.

In some implementations, in a case where the plurality of hole caps 854 are provided, the vanes 8542 provided in the respective hole caps 854 can be disposed in the same direction or in different directions.

For example, the hole caps 854 can be combined with the dry air supply holes 263 inside the tub 20 so as to be relatively rotated to the dry air supply holes 263. In some implementations, the vanes 8542 of the respective hole caps 854 can be disposed in different directions.

In some implementations, the vanes 8542 can be disposed in different directions, and the discharge direction of the dry air passing through the respective hole caps 854 can be differently provided to evenly supply the dry air into the tub 20.

In some implementations, to prevent the reduction of the washing space 21 in accordance with the amount of projection of the hole cap 854 into the tub 20, as illustrated in FIG. 3, the dry air supply hole 263 can be provided at a bead forming part 262 that is projected toward the outside of the tub 20.

In some implementations, to cope with the projection amount of the hole cap 854, the projection amount of the bead forming part 262 can be provided to be equal to or greater than the projection amount of the hole cap 854.

The dry air supply part 80 can further include a filtering part 87 configured to filter the air flowing into the blower fan 82.

The filtering part 87 can be combined with an upstream side of the blower fan 82 based on the flow direction of the dry air so as to block dust or the like from sticking to the blower fan 82 and the heater 84.

As illustrated in FIG. 5, for example, the filtering part 87 can include a filter 871 configured to filter an external air, a cylindrical filter housing 872 in which the filter 871 is accommodated, and a connection duct 873 configured to connect the filter housing 872 and the blower fan 82 with each other.

As illustrated, the filter 871 can have a cylindrical shape, and the filtering flow can be provided in a manner that the external air is introduced from an outer periphery of the filter 871, is filtered, and then passes through an inner periphery of the filter 871.

At an outer periphery of a housing body 8721 of the filter housing 872, a plurality of intake vents 8721*a* can be provided corresponding to the position where the filter 871 is disposed. To enhance the filtering efficiency, the outer periphery of the filter 871 can be maintained to be in close contact with the inner periphery of the filter housing 872, which makes it possible to allow the air having passed through the plurality of intake vents 8721*a* to directly pass through the outer periphery of the filter 871, and then be introduced into the filter 871.

The housing body 8721 can have an opening at an upper side, and the filter 871 can be inserted or discharged through the opening at the upper side.

The upper side of the housing body 8721 can extend in an upward direction (U-direction) toward the lower surface of the tub 20, and the upper side of the housing body 8721 can pass through the lower surface of the tub 20 at least partly, and can project toward the inside of the tub 20.

A fastening part 8722 having a male screw can be provided at the upper end of the housing body 8721 extending to project into the tub 20, and a sealing cap 874 can be screw-fastened to the fastening part 8722.

Through the sealing cap 874, the washing water sprayed during the washing process or the rinsing process can be blocked from flowing into the filter housing 872.

The replacement of the filter 871 can be easily performed in a manner that after the sealing cap 874 is separated from the fastening part 8722, the upper side of the housing body 8721 is exposed, and the filter 871 is discharged in the upward direction (U-direction) from the housing body 8721 through the opening at the upper side of the housing body 8721.

In consideration of easy replacement of the filter 871 and user's accessibility, the upper end of the filter housing 872 can be disposed at a position adjacent to the front of the tub 20. Such a position can be a position where the user can easily access the filter 871 in a state where the door 30 is opened.

In some implementations, for increasing the sealing performance of the sealing cap 874, a ring-shaped flange 8723 can be provided at the filter housing 872. The ring-shaped flange 8723 can be a part that comes into close contact with the lower side of the lower surface of the tub 20, and the flange 8723 can receive a pulling force toward the lower surface of the tub 20 by a contact force of the sealing cap 874, which makes it possible to increase a contact force between the flange 8723 and the lower surface of the tub 20. Through this configuration, the possibility of washing water leakage through the outer periphery of the filter housing 872 may be significantly reduced.

In some implementations, the connection duct 873 can provide fluid connection between the discharge port provided at the outer periphery of the filter housing 872 and the blower fan 82.

An air path can be provided inside the connection duct 873, and a communication hole 8731 of the connection duct 873 can be in direct fluid connection with the entrance side of the blower fan 82.

Hereinafter, a door lock, an opening part 35 provided in the dish washer 1 will be described with reference to FIGS. 6 and 7.

As illustrated, the dish washer 1 can include the door lock, the opening part 35, which can automatically release the lock state of the door 30, and open the door 30 up to a middle stop position P3.

First, the door lock-opening part 35 may include a door lock module 351 that maintains or releases the lock state of the door 30.

As illustrated, for example, the door lock module 351 can be provided at a position adjacent to the opening at the front side as the upper surface 24 of the tub 20, and can be disposed at the position adjacent to the front of the tub 20 as the upper surface 24 of the tub 20. On the upper surface 24 of the tub 20, an upper front bracket 241 for installation of the door lock module 351 can be provided.

The door lock module 351 can include a hook-shaped door latch that is lock-engaged with a latch lock part 39 of the door 30, and a latch drive part configured to release the lock state of the door latch by using an electrical driving force.

On the upper surface of the door 30, a latch lock part 39 provided concavely to be combined with the hook-shaped door latch can be provided.

In some implementations, on the right side of the door lock module 351, an automatic door opening module 352 configured to partly open the front of the tub 20 at least partly by rotating the door 30 from a closing position P1 to the middle stop position P3 can be provided.

In some implementations, the middle stop position P3 can be defined as a position where the rotation force by the weight of the door 30 and an elastic force of a restoring force applying part 38 configured to provide a restoring force to the door 30 equalize each other. For providing a restoring force to the door 30, the restoring force applying part 38 can include a return spring 383 as an elastic member, a coupler 384, a rope 381, and a rope connector 382.

If an electrical control signal for opening the door 30 is received from the controller 100, the automatic door opening module 352 can be configured to be electrically driven and to rotationally open the door 30 from the closing position P1 to the middle stop position P3.

In some implementations, the automatic door opening module 352 can include a drive motor 3522 configured to generate an electrical rotational driving force, a reduction gear part 3523 configured to reduce the rotational driving force of the drive motor 3522 and to convert the rotational driving force into a linear reciprocating driving force, and a push rod 3524 configured to reciprocate in a straight line in a front-rear direction (F-R direction) by the linear reciprocating driving force.

The drive motor 3522, the reduction gear part 3523, and the push rod 3524 can be installed on the upper front bracket 241 in a state where they are accommodated inside a housing 3521.

In some implementations, the drive motor 3522 can be driven by the power supplied from the controller 100, and the push rod 3524 can project from an initial accommodation position toward the door 30 by the driving force of the drive motor 3522, and thus can push the upper side of the rear surface of the door 30.

Accordingly, the door 30 can be rotated while moving from the closing position P1, and the opening of the front of the tub 20 can start.

Thereafter, if the push rod 3524 projects to a maximum distance to push the door 30, the door 30 can reach the middle stop position P3, and the push rod 3524 can return back to the initial accommodation position.

In some implementations, if the door 30 returns to the initial accommodation position, and the pressing force of the push rod 3524 can be released, the door 30 can maintain a stop state at the middle stop position.

For example, if the door 30 reaches the middle stop position, the distance between the upper end of the door 30 and the upper surface 24 of the tub 20 can be about 82 mm.

The distance can be an optimum distance at which the inside of the tub 20 can effectively maintain a proper level of high-temperature atmosphere while the high-temperature dry air is supplied, and a moist air can be discharged to the outside at the same time. In some implementations, the dry performance and efficiency of the hot air drying process can be considerably improved.

Figure 7:
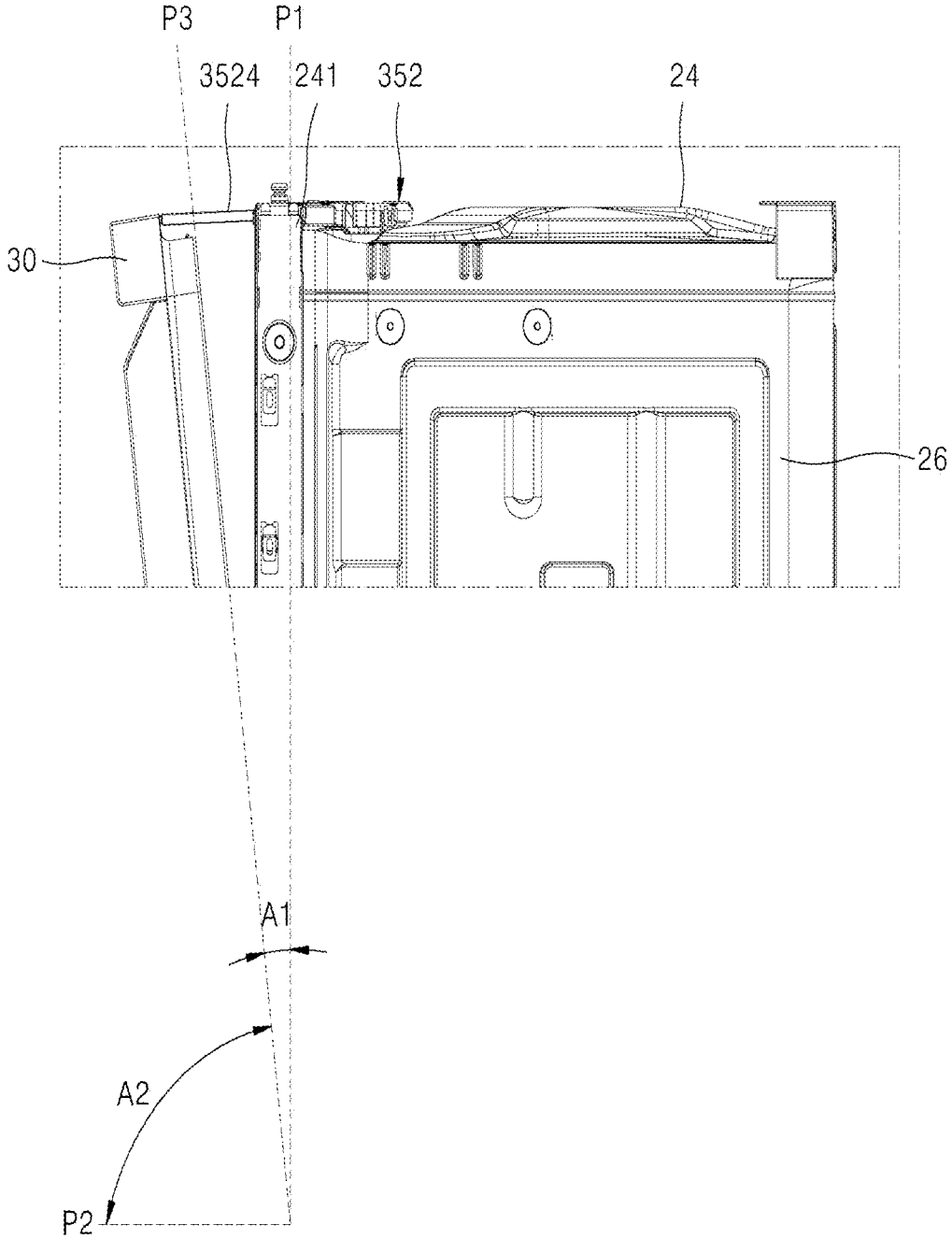
FIG. 7 is a diagram illustrating a state where a door is opened by a door opening module in the left side view of FIG. 6.

As illustrated in FIG. 7, based on the middle stop position P3, the area between the closing position P1 and a full opening position P2 can be divided into an automatic opening area A1 corresponding to an area in which the door 30 is rotated by the automatic door opening module 352 and a manual opening area A2 corresponding to an area in which the door 30 is rotated by a user.

In some implementations, the door lock module 351 and the automatic door opening module 352 can be electrically driven to release the lock state of the door 30 and be electrically driven to rotate the door 30 from the closing position P1 to the middle stop position P3.

Hereinafter, the detailed configuration of a door position sensing part 36 provided in the dish washer 1 will be described.

Figure 6:
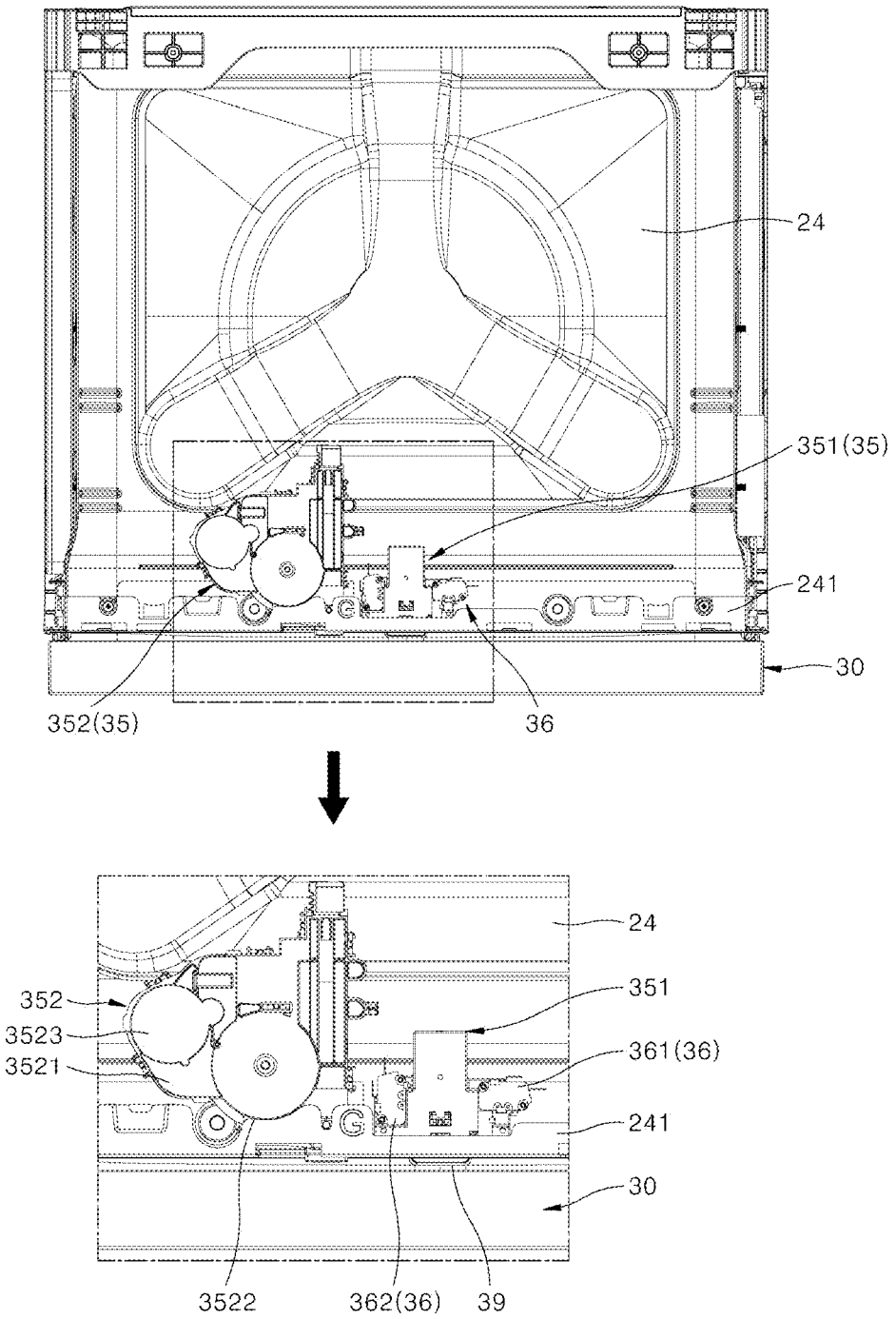
FIG. 6 is a diagram illustrating a plan view and a partially enlarged view illustrating a state where a case of the example of the dish washer illustrated in FIG. 1 is removed.

First, as illustrated in FIG. 6, the door position sensing part 36 can include a main sensor configured to sense whether the door 30 is at the closing position P1 or is moving from the closing position P1.

For example, the main sensor can include a micro switch configured to generate and output an ON signal when the door 30 is at the closing position P1 and configured to generate and output an OFF signal when the door 30 moves from the closing position P1.

In some implementations, the micro switch can be provided with a push button maintaining a pressed state when the door 30 is at the closing position P1 and of which the pressed state is released when the door 30 moves from the closing position P1. Inside the micro switch, an electrical circuit can be provided, which senses whether the push button is pressed and generates an electrical output signal including the ON signal or the OFF signal.

For example, FIG. 6 illustrates that the main sensor composed of two micro switches has the same standard and size. Although the disclosure is not limited thereto, explanation will be made based on the implementation in which two contact type micro switches are provided as the main sensor. For convenience in explanation, the micro switch disposed on the left side of the door lock module 351 is referred to as a first main sensor 361, and the micro switch disposed on the right side of the door lock module 351 is referred to as a second main sensor 362.

As illustrated, the first main sensor 361 and the second main sensor 362 can be disposed at both side surfaces of the door lock module 351, can constitute an assembly together with the door lock module 351, and can be disposed at and coupled to the upper front bracket 241.

The first main sensor 361 and the second main sensor 362 can be configured as the micro switches having the same standard and size, but the arrangement directions of the first main sensor 361 and the second main sensor 362 may be differently configured.

For example, by differently configuring the arrangement directions of the first main sensor 361 and the second main sensor 362, the positions in which the push buttons of the first main sensor 361 and the second main sensor 362 are pressed may be differently formed.

For example, in case that the door 30 is at the closing position P1, the push button of the first main sensor 361 can be arranged to be pressed by the upper surface of the door 30, and the push button of the second main sensor 362 can be arranged to be pressed by the rear surface of the door 30.

As described above, by configuring the main sensors with the plurality of micro switches and making them contact the door 30 at different positions, reliability for position sensing performance of the door 30 can be improved.

For example, if malfunction occurs in any one of the first main sensor 361 and the second main sensor 362 and if the door 30 is not opened to a position to determine the open state of the door 30, the closed state or the open state of the door 30 can be accurately specified.

In some implementations, the first main sensor 361 and the second main sensor 362 can be electrically connected to the controller independently or individually.

If at least any one of the output signals received from the first main sensor 361 or the second main sensor 362 is the ON signal, the controller 100 can determine that the door 30 is at the closing position P1 and the door 30 does not move from the closing position P1.

Further, in a case where the output signals received from the first main sensor 361 and the second main sensor 362 are all switched to the OFF signals, the controller 100 can determine that the door 30 normally moves from the closing position P1 and the door 30 starts to open at least partially.

In some implementations, the configuration of the micro switch applied to the first main sensor 361 and the second main sensor 362 can be applicable to a micro switch 3632, provided in a sub-sensor 363, in the same manner.

In some implementations, the door position sensing part 36 can include the sub-sensor 363 configured to sense whether the door 30 reaches a risk area start position P4.

Similar to the above-described main sensor, the sub-sensor 363 can include the micro switch 3632 that outputs an ON signal if the door 30 is positioned between the closing position P1 and the risk area start position P4, and that outputs an OFF signal if the door 30 reaches the risk area start position P4.

However, unlike the main sensor that detects the position of the door 30 by coming into direct contact with the door 30, the sub-sensor 363 is configured to indirectly detect the position of the door 30.

Figure 8:
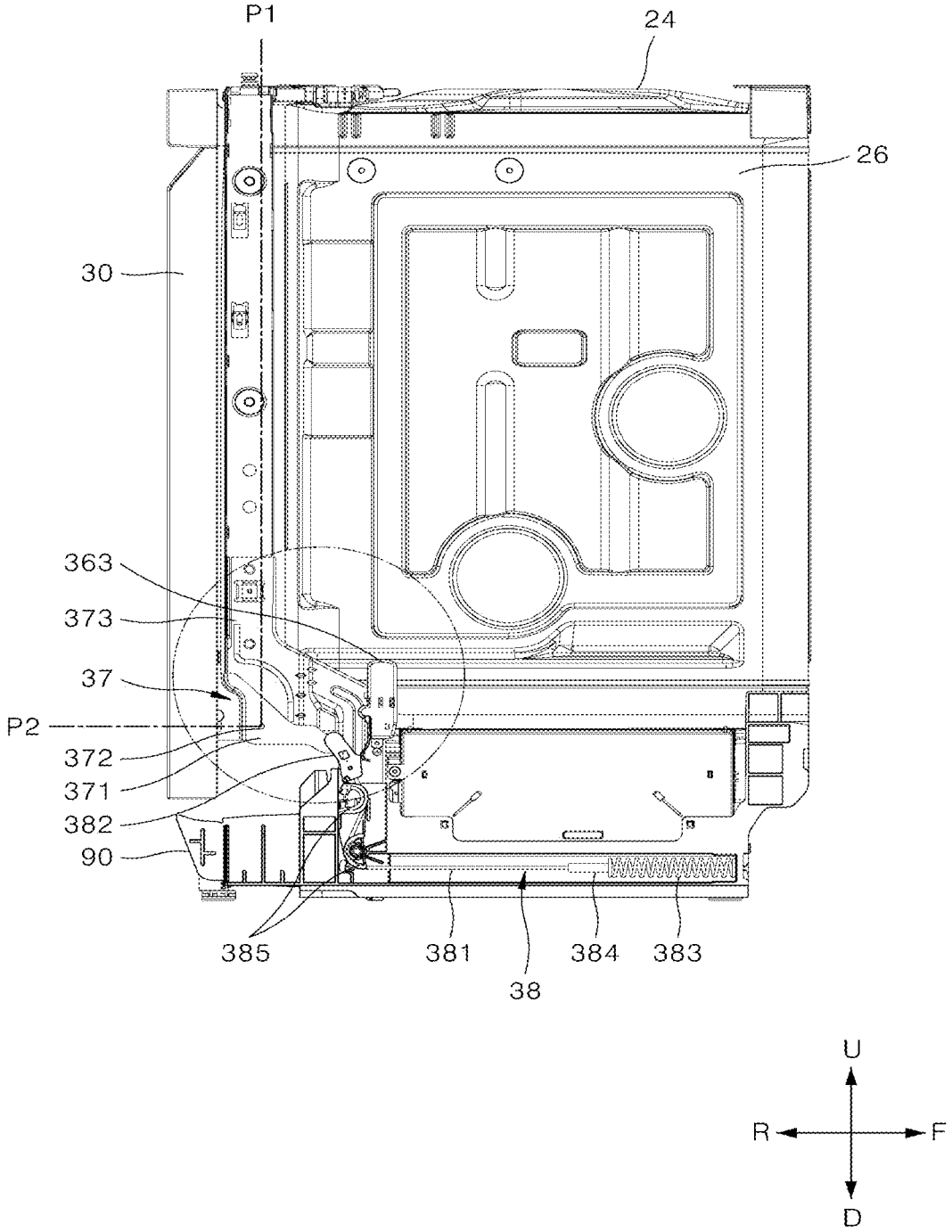
FIG. 8 is a diagram illustrating a left side view when a door is at a closing position and the case of the example of the dish washer illustrated in FIG. 1 is removed.

For example, FIG. 8 illustrates that the sub-sensor 363 detects the position of the door 30 by detecting the position of a hinge bracket 371 constituting a door support part 37, more specifically, the position of the rope connector 382 that moves in conjunction with the rotation of the hinge bracket 371.

Figure 9:
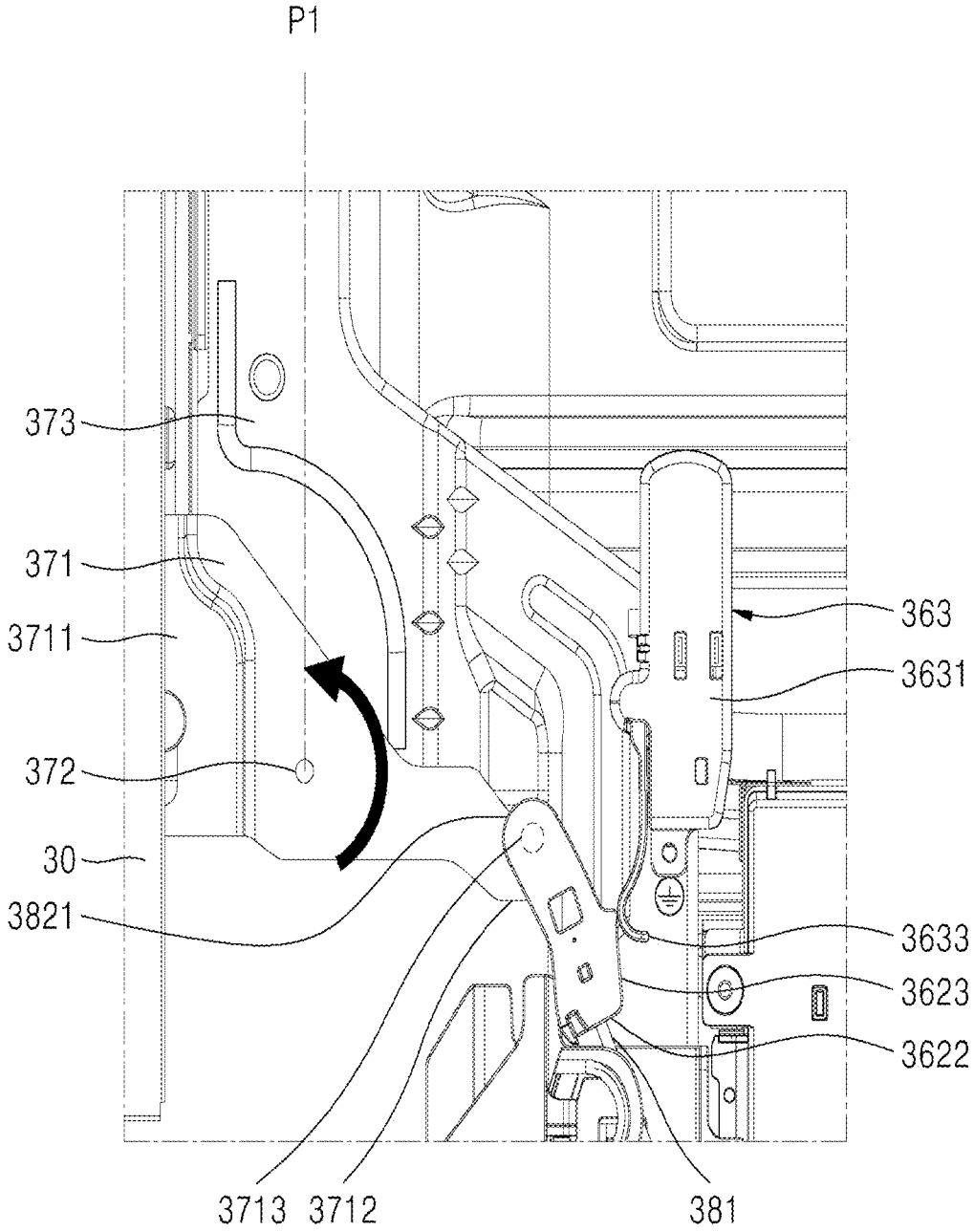
FIG. 9 is a diagram illustrating a partially enlarged view of FIG. 8.

As illustrated, one end part 3821 of the rope connector 382 constituting the restoring force applying part 38 can be rotatably connected to a connector shaft 3713 provided at a rear end 3712 of the hinge bracket 371 (see FIG. 9). Further, the other end part 3822 of the rope connector 382 can be connected to the elastic member, which generates the restoring force, through the rope 381 (see FIG. 11). In some implementations, the elastic member can be the return spring 383 configured to generate a tensile force, and the return spring 383 can be connected to the rope 381 through the coupler 384. The rope 381 extending from the lower part of the base 90 in the front-rear direction (F-R direction) can be connected to the other end part 3822 of the rope connector 382 as the path of the rope 381 is switched through a rope guide 385.

In some implementations, the micro switch 3632 of the sub-sensor 363 can be disposed at and coupled to the rear of the hinge bracket 371 and the rope connector 382, and can use a push button 3632*c* directly or indirectly pressed or depressurized by the rope connector 382 in accordance with the movement range of the rope connector 382.

Similar to the main sensor, the micro switch 3632 of the sub-sensor 363 can be configured to output the ON signal when the push button 3632*c* is in a pressed state or to output the OFF signal when the pressed state is released. The controller 100 can detect the position of the rope connector 382 and the position of the hinge bracket 371 through reception of the ON signal or the OFF signal generated from the micro switch 3632 of the sub-sensor 363, and can detect the position of the door 30 based on the detected positions.

The disclosure is not limited thereto, but hereinafter, as exemplarily illustrated, explanation will be made based on the implementation of the sub-sensor 363 that senses the position of the door 30 by detecting the position of the rope connector 382.

As illustrated in FIGS. 8 and 9, in a case where the door 30 is at the closing position P1, the micro switch 3632 of the sub-sensor 363 can be configured so that the push button 3632*c* is in an indirectly pressed state by the pressing force of the rope connector 382. Accordingly, the micro switch 3632 of the sub-sensor 363 can output the ON signal. In some implementations, for transferring the pressing force of the rope connector 382, a pivot lever 3633 can be provided between the rope connector 382 and the push button 3632*c*. The detailed configuration of the pivot lever 3633 will be described below with reference to FIG. 13.

Figure 10:
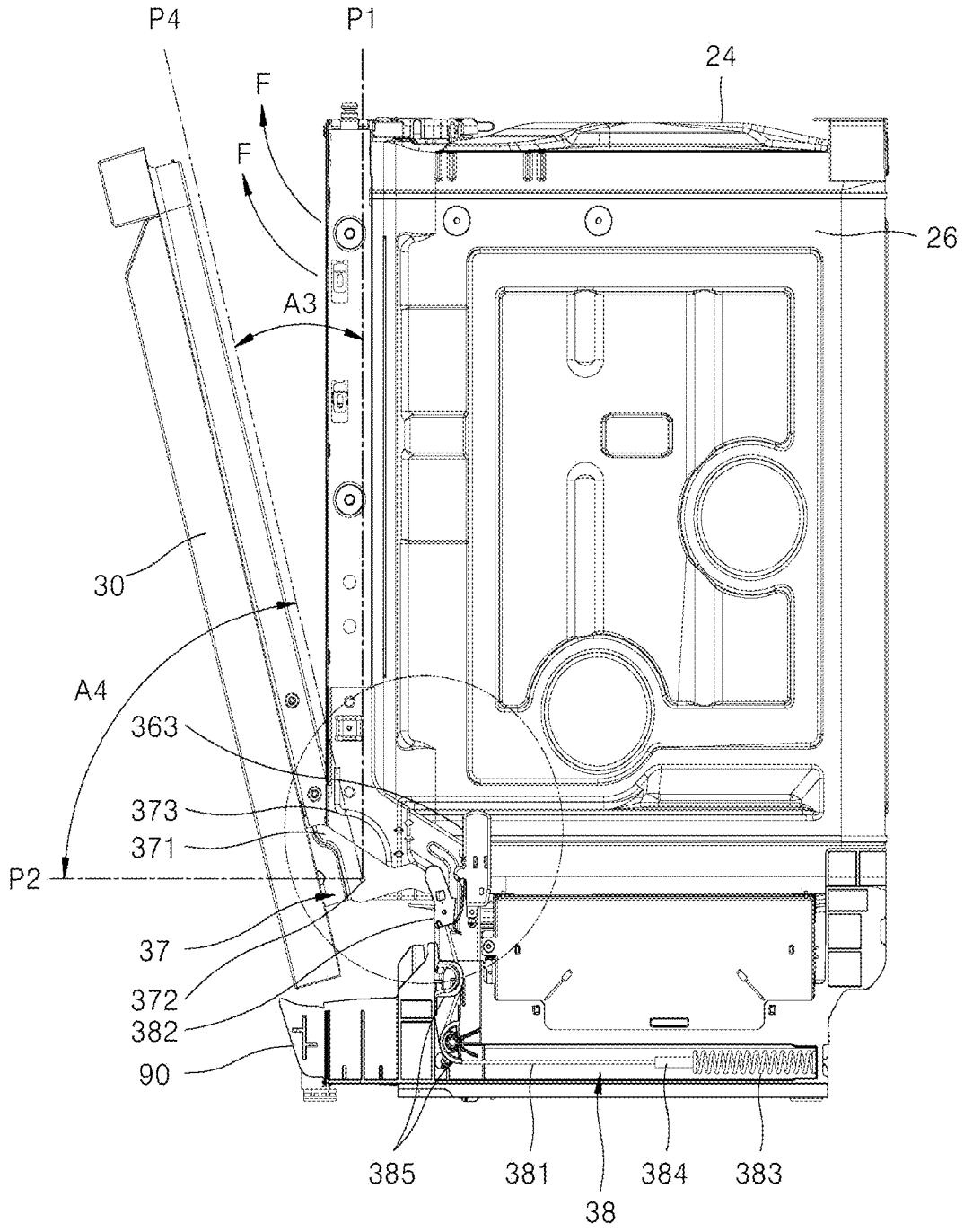
FIG. 10 is a diagram illustrating a left side view when a state where a door is opened up to a middle stop position in FIG. 8.
Figure 11:
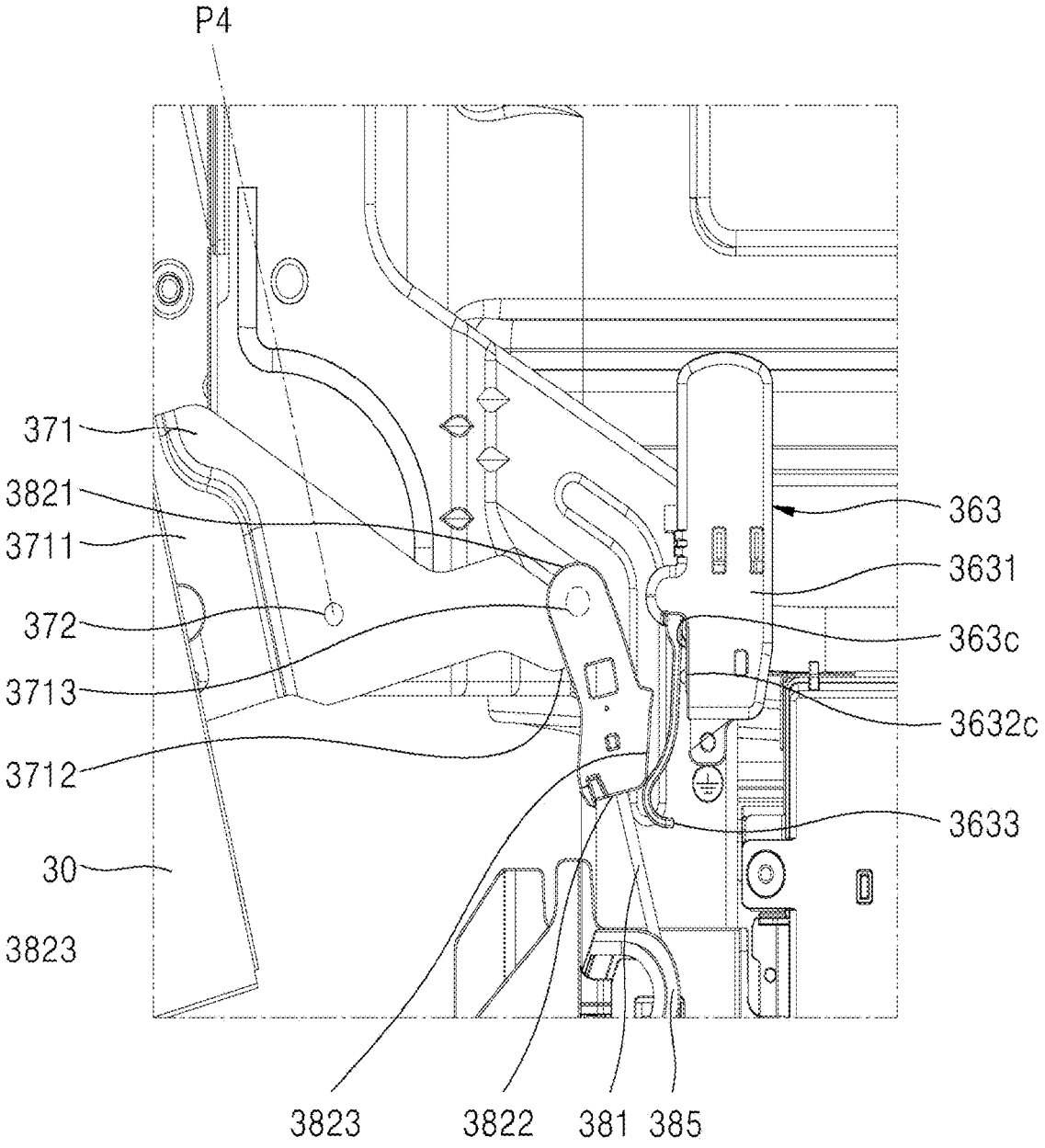
FIG. 11 is a diagram illustrating a partially enlarged view of FIG. 9.

In some implementations, as illustrated in FIGS. 10 and 11, in a case where the door 30 reaches the risk area start position P4 after passing through the above-described middle stop position P3, the rope connector 382 can be configured so that the pressing force of the rope connector 382 is released while the rope connector 382 moves in conjunction with the rotation of the door 30, and the pressed state of the push button 3632*c* is released. Accordingly, the micro switch 3632 of the sub-sensor 363 can output the OFF signal.

In some implementations, if the door 30 moves from the closing position P1 toward the risk area start position P4, the rope connector 382 can move in conjunction with the rotation of the door 30, but the pressed state of the push button 3632*c* can be maintained. Accordingly, the output signal of the micro switch 3632 of the sub-sensor 363 can be maintained as the ON signal.

If the door 30 reaches the risk area start position P4, for example, the distance between the upper end of the door 30 and the upper surface 24 of the tub 20 can reach about 163 mm, and the corresponding distance can reach a distance in which a user's hand can enter the tub 20.

Accordingly, the risk area start position P4 can become the position in which a user's scald is highly likely to occur due to the high-temperature dry air while the drying process is performed in a high-temperature dry air supply mode. In consideration of this situation, the area between the risk area start position P4 and the full opening position P2 can be defined as a risk area A4. In contrast, the area between the closing position P1 and the risk area start position P4 can be defined as a safety area A3.

The safety area A3 and the risk area A4 will be described in association with the automatic opening area A1 and the manual opening area A2 described above.

Figure 12:
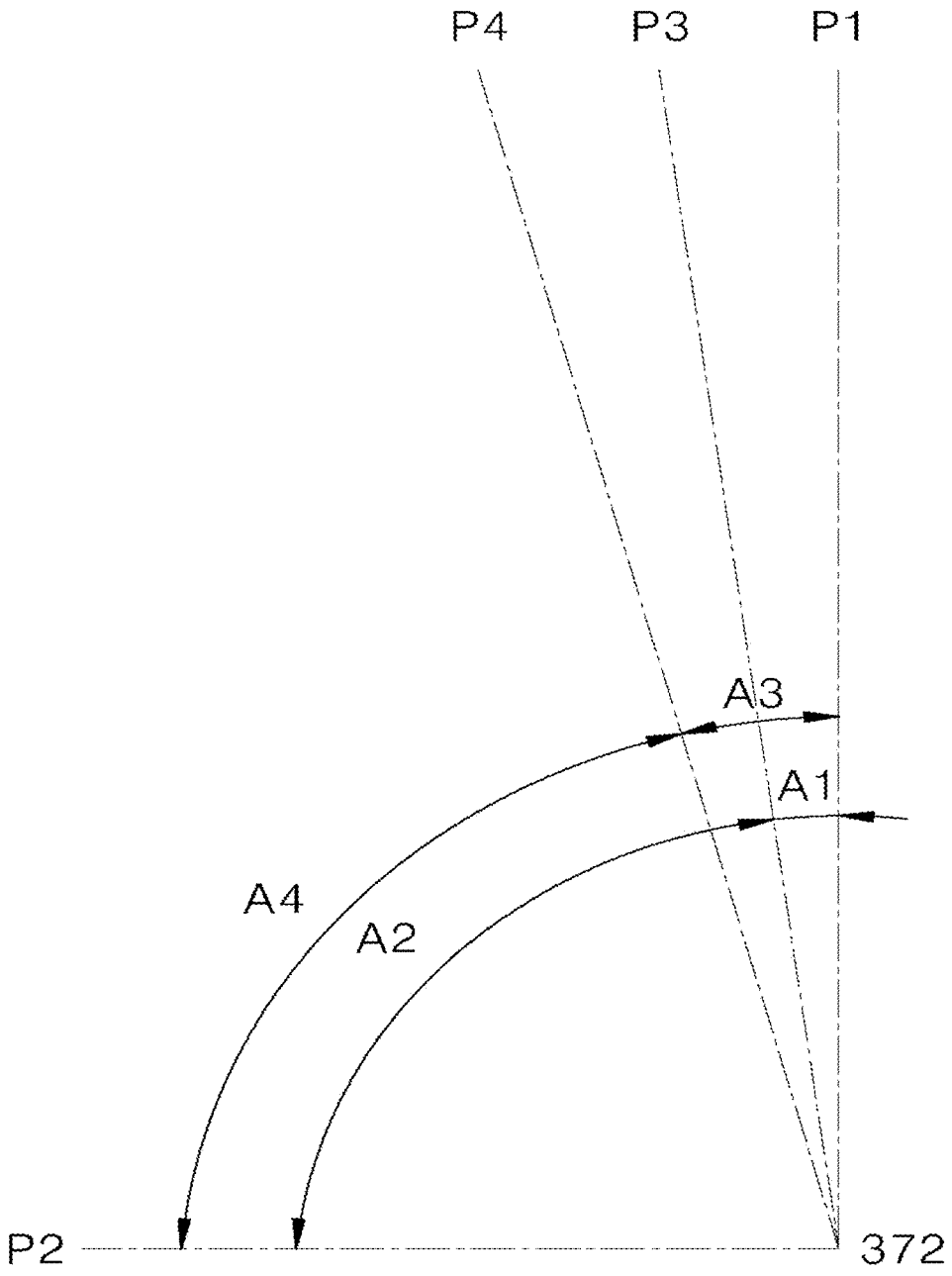
FIG. 12 is a diagram for explaining the positions of a door illustrated in FIGS. 8 to 11 and areas divided accordingly.

As illustrated in FIG. 12, the area provided between the closing position P1 and the middle stop position P3 can be defined as the automatic opening area A1, and the area provided between the middle stop position P3 and the full opening position P2 can be defined as the manual opening area A2.

In some implementations, if the door 30 is additionally and manually opened from the middle stop position P3 toward the full opening position P2 by the user or by an external force, the door 30 can reach the above-described risk area start position P4.

Accordingly, referring to FIG. 12, the area between the closing position P1 and the middle stop position P3 can be the automatic opening area A1 based on the automatic opening or not, and can be the safety area A3 based on the safety or not.

Further, the area between the middle stop position P3 and the risk area start position P4 can be the manual opening area A2 based on the automatic opening or not, and can be the safety area A3 based on the safety or not.

Further, the area between the risk area start position P4 and the full opening position P2 can be the manual opening area A2 based on the automatic opening or not, and can be the risk area A4 based on the safety or not.

Hereinafter, the detailed configuration of the sub-sensor 363 will be described with reference to FIGS. 13, 14, 15, 16, 17, and 18.

First, referring to FIGS. 13, 14, 15, and 16, the sub-sensor 363 of the dish washer 1 can include a sensor housing 3631 configured to accommodate the micro switch 3632 therein, and the pivot lever 3633 rotatably connected to the sensor housing 3631.

The sensor housing 3631 can have a box shape with an accommodation space defined therein and an opening at one side. A micro sensor can be accommodated in the internal accommodation space.

To provide the accommodation space, a border wall can be successively provided, which is provided along an outer periphery of a bottom surface 3631*a* of the sensor housing 3631 and has a predetermined height from the bottom surface 3631*a*.

Further, on the bottom surface 3631*a* of the sensor housing 3631, a pair of position determination bosses 3631*e* that is projected toward the opening can be provided.

When the micro switch 3632 is combined with the sensor housing 3631, the pair of position determination bosses 3631*e* can be inserted into position determination holes 3632*d* provided in the micro switch 3632, such that the combination of the micro switch 3632 can be guided. In some implementations, the position in which the pair of position determination bosses 3631*e* and a pair of micro switches 3632 are provided can be selected as the position capable of blocking the misassemble of the micro switches 3632.

For example, as illustrated, the one pair of position determination holes 3632*d* can be arranged in a diagonal direction of a switch body 3632*a*. Due to an influence of a structure, such as a terminal 3632*b* extending to project from the switch body 3632*a*, the switch body 3632*a* may not enter or be assembled with the sensor housing 3631 in different directions.

In some implementations, on the bottom surface 3631*a* of the sensor housing 3631, a fastening hook 3631*f* provided to project toward the opening can be further provided.

One end part of the fastening hook 3631*f* can be coupled to the bottom surface 3631*a* of the sensor housing 3631, and at the other end part of the fastening hook 3631*f* that becomes a free end part, a hook part can be provided.

After a process, in which the micro switch 3632 is combined within the accommodation space of the sensor housing 3631 through the above-described position determination boss 3631*e*, is completed, the fastening hook 3631*f* can be coupled to the micro switch 3632.

Figure 13:
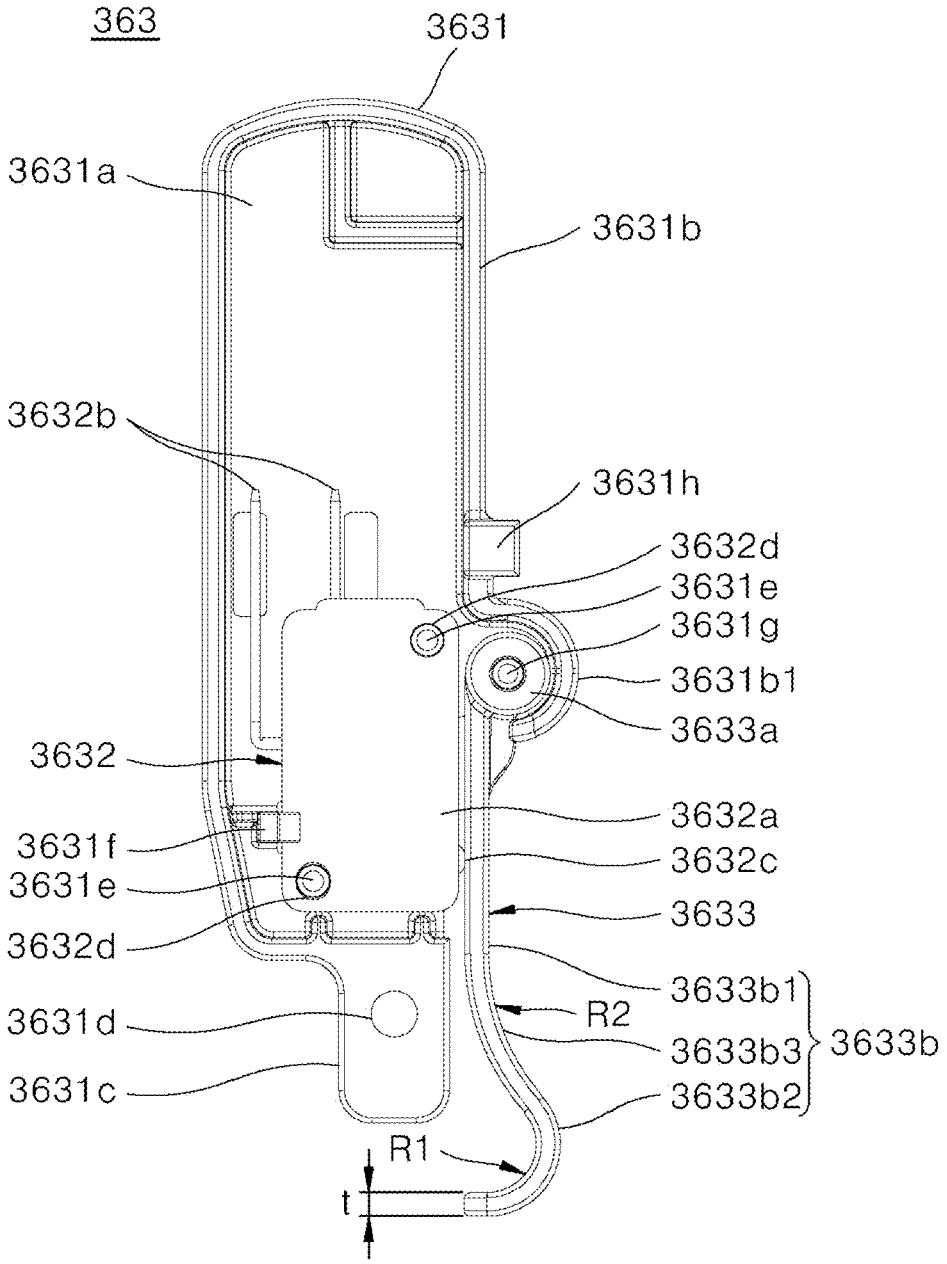
FIG. 13 is a diagram illustrating a sub-sensor provided in an example of a dish washer.
Figure 14:
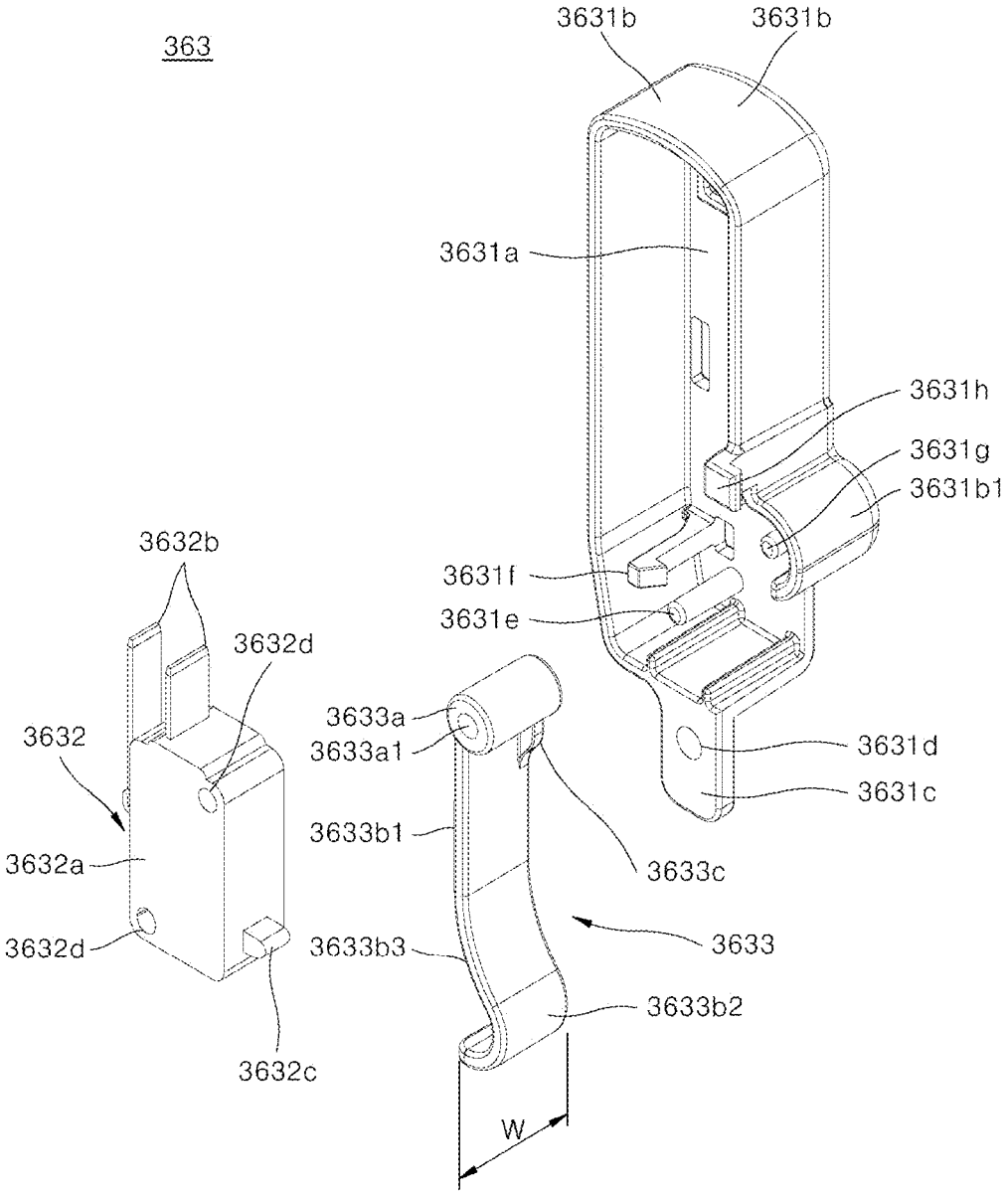
FIG. 14 is a diagram illustrating an exploded perspective view of FIG. 12.

As illustrated in FIG. 13, if the combination with the micro switch 3632 is completed, a lock state is provided between the hook part of the fastening hook 3631*f* and a sensor body of the micro switch 3632, and thus the coupling of the micro switch 3632 can be completed.

In some implementations, the sensor housing 3631 can be coupled to a supporter bracket 373 that couples the tub 20 to the base 90.

As illustrated in FIGS. 9, 10, and 11, a supporter body 3731 of the supporter bracket 373 constituting the door support part 37 can include an upper bracket coupled to the tub 20 and a lower bracket coupled to the base 90.

On the lower end side of the upper bracket of the supporter bracket 373, the hinge bracket 371 having a front end 3711 coupled to the lower part side of the door so as to rotatably support the door 30 can be rotatably supported through a hinge shaft 372.

The sensor housing 3631 can be coupled to the rear side of the hinge bracket 371, and to the lower bracket of the supporter bracket 373 as the rear side of the rope connector 382.

In some implementations, the sensor housing 3631 can be coupled to a position where the opening of the sensor housing 3631 can be at least partly closed by the lower bracket.

To couple the sensor housing 3631, at the lower end of the sensor housing 3631, a fastening tap 3631*c* provided to extend from a border wall 3631*b* in a downward direction (D direction) can be integrally provided, and a screw hole 3631*d* can be provided in the fastening tap 3631*c*.

A screw hole 3733 can be provided in the supporter bracket 373 as the position corresponding to the screw hole 3631*d* of the fastening tap 3631*c*, and the sensor housing 3631 can be coupled to the supporter bracket 373 through a fastening means, such as a screw bolt extending to pass through the screw hole 3733.

For fixing the sensor housing 3631, a lock tap 3631*h* provided to project from the border wall 3631*b* of the sensor housing 3631 toward the outside can be further provided.

The lock tap 3631*h* can be coupled to the supporter bracket 373 in a manner that it is lock-combined with a lock hole 3732 provided in the supporter bracket 373. The detailed configuration thereof will be described later with reference to FIGS. 17 and 18.

In some implementations, the sensor housing 3631 can be provided with a boss-shaped lever shaft 3631*g* provided to project from the bottom surface 3631*a* toward the opening of the sensor housing 3631.

For example, the lever shaft 3631*g* can be provided at a position between the rope connector 382 and the micro switch 3632.

For example, as illustrated in FIG. 13, the lever shaft 3631*g* can be provided at a position more adjacent to the rope connector 382 than the border wall 3631*b* provided toward the rope connector 382.

The lever shaft 3631*g* plays a role of rotatably supporting the pivot lever 3633 to be described later, and functions as a rotation shaft of the pivot lever 3633.

In some implementations, around the lever shaft 3631*g*, a secession prevention wall 3631*b*1 arranged to surround a cylindrical base part 3633*a* of the lever shaft 3631*g* can be provided.

For example, on one end part of the secession prevention wall 3631*b*1, the border wall 3631*b* provided on the upside can be integrally provided, and can be provided in a wall part extending in an arc shape from the border wall 3631*b*.

The projection height of the secession prevention wall 3631*b*1 from the bottom surface 3631*a* of the sensor housing 3631 can be substantially the same as the projection height of the lever shaft 3631*g*.

Accordingly, in a state where the sensor housing 3631 is fastened to the supporter bracket 373, the secession prevention wall 3631*b*1 and the lever shaft 3631*g* can simultaneously come into contact with the supporter bracket 373.

In some implementations, the other end part of the secession prevention wall 3631*b*1 functions as a stopper that limits the maximum rotation range of the pivot lever 3633.

Figure 15:
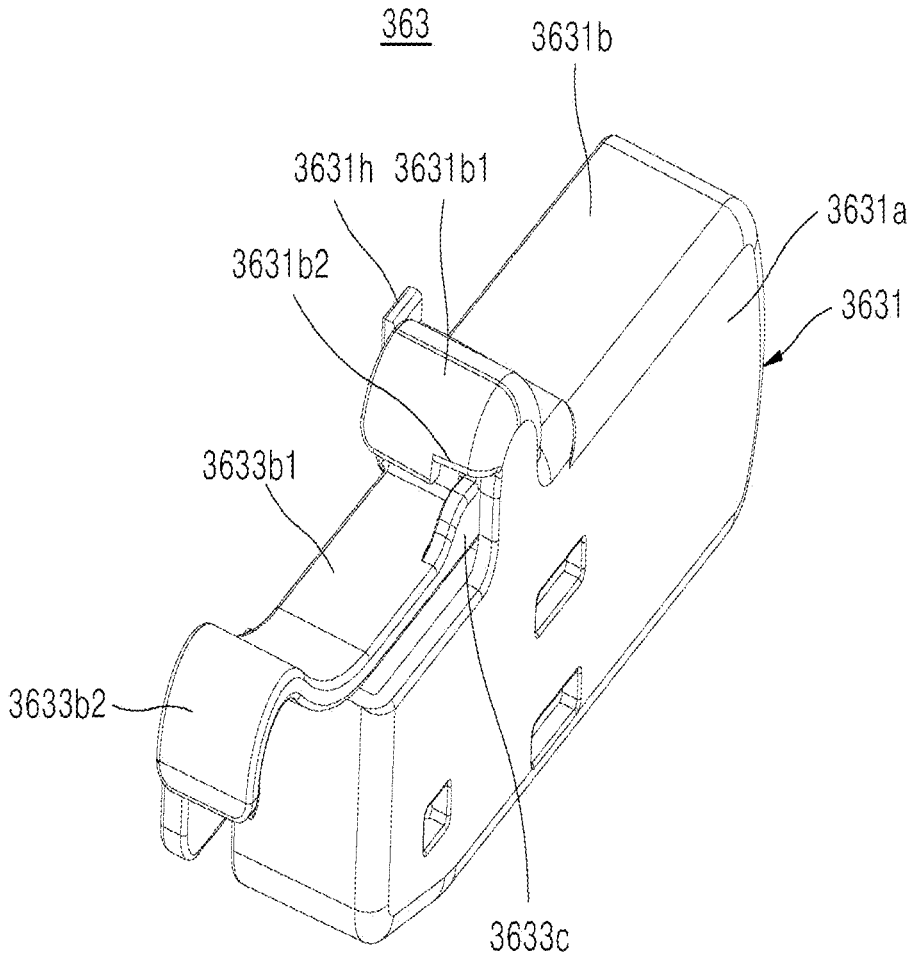
FIG. 15 is a diagram illustrating a side perspective view of the sub-sensor of FIG. 12.
Figure 16:
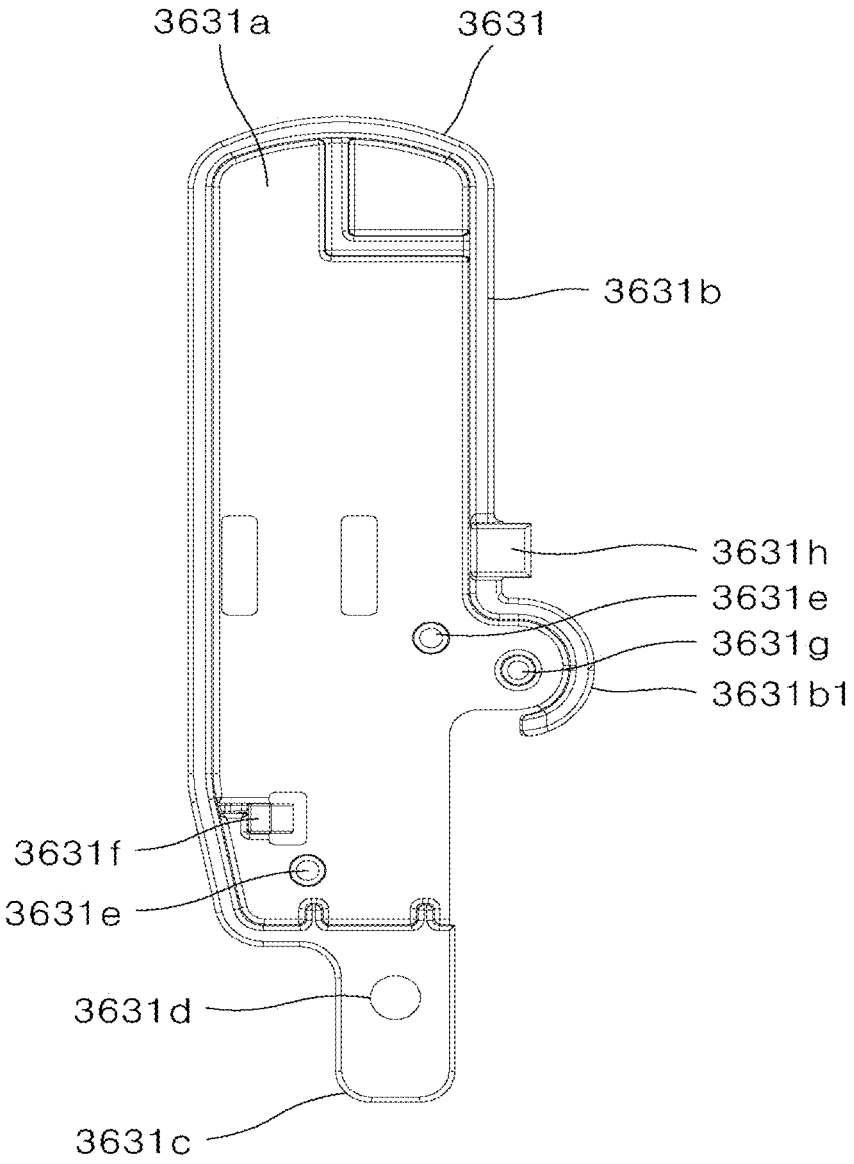
FIG. 16 is a diagram illustrating a front view of an example of a sensor housing of the sub-sensor.

Further, as illustrated in FIG. 15, in the other end part of the secession prevention wall 3631*b*1, a lock groove 3631*b*2 extending from the bottom surface of the sensor housing 3631 in a length direction of the lever shaft 3631*g* can be provided.

The lock groove 3631*b*2 can be provided through cutting of a part of the secession prevention wall 3631*b*1, and can be a straight groove extending in a straight line along the length direction of the lever shaft 3631*g* with a constant depth.

As illustrated in FIG. 15, a secession prevention projection 3633*c* that is at least partially inserted into the lock groove 3631*b*2 can be provided on the pivot lever 3633.

Accordingly, in a state where the pivot lever 3033 is combined with the lever shaft 3631*g*, the movement range in a rotation axis direction of the secession prevention projection 3633*c* of the pivot lever 3633 can be limited by the lock groove 3631*b*2. Through this configuration, the lock groove 3631*b*2 can block an axis-direction movement of the pivot lever 3633.

In some implementations, the pivot lever 3633 can be rotatably coupled to the lever shaft 3631*g*.

For example, the pivot lever 3633 can include the cylindrical base part 3633*a* configured to provide a rotation center and a rod part 3633*b* extending from the cylindrical base part 3633*a* toward the other end in a radius direction.

In the center of the cylindrical base part 3633*a*, a shaft hole 3633*a*1 into which the lever shaft 3631*g* is inserted can be provided to pass through the cylindrical base part 3633*a*.

In some implementations, in a direction parallel to the rotation axis, the width of the cylindrical base part 3633*a* and the width of the shaft hole 3633*a*1 can be provided to be equal to or less than the projection length of the lever shaft 3631*g*.

The rod part 3633*b* can be disposed so that one side surface thereof comes into contact with the rope connector 382, and can be configured to transfer a pressing force of the rope connector 382 to the push button 3632*c* of the micro switch 3632.

For example, the other side surface on the opposite side of the rod part 3633*b* can be configured to come into direct contact with and to press the push button 3632*c* of the micro switch 3632.

By way of further example, the rod part 3633*b* can include a linear extension part 3633*b*1 extending from the cylindrical base part 3633*a* toward the outside in a radius direction, and a hook-shaped part 3633*b*2 provided on the outside in the radius direction of the linear extension part 3633*b*1.

One end part of the linear extension part 3633*b*1 can be connected to the outer periphery of the cylindrical base part 3633*a*, and the other end part of the linear extension part 3633*b*1 can extend in a straight line from the outer periphery of the cylindrical base part 3633*a* toward the outside in the radius direction. In some implementations, the one end part of the linear extension part 3633*b*1 can be integrally connected to the outer side surface of the cylindrical base part 3633*a*.

The linear extension part 3633*b*1 can be configured to press the push button 3632*c* of the micro switch 3632.

Accordingly, so that the linear extension part 3633*b*1 can effectively press the push button 3632*c*, the linear extension part 3633*b*1 can be disposed maximally adjacent to the one side surface of the switch body 3632*a* of the micro switch 3632 on which the push button 3632*c* is disposed.

Accordingly, as illustrated in FIG. 13, the other end part of the linear extension part 3633*b*1 can be provided to extend from the cylindrical base part 3633*a* in a tangential direction, and the other end part of the linear extension part 3633*b*1 can extend over the range where the one side surface of the switch body 3632*a* is provided.

As illustrated, the hook-shaped part 3633*b*2 can correspond to a part which comes into direct contact with the one side surface of the rope connector 382 that functions as a pressing surface 3823, and to which the pressing force of the rope connector 382 is applied.

As described above, the rope connector 382 can move in conjunction with the rotation of the hinge bracket 371 for opening or closing of the door 30.

To effectively maintain the contact state for the moving rope connector 382, the hook-shaped part 3633*b*2 can be convexly curved in a proximity direction toward the rope connector 382.

In some implementations, the hook-shaped part 3633*b*2 provided to be curved such that a radius of curvature is constant.

In some implementations, a connection part 3633*b*3 provided to be convexly curved in a direction in which the connection part gets far away from the rope connector 382 can be provided between the linear extension part 3633*b*1 and the hook-shaped part 3633*b*2.

For example, the direction in which the connection part 3633*b*3 is curved can be configured to be opposite to the direction in which the hook-shaped part 3633*b*2 is curved.

As described above, the dish washer 1 can indirectly sense whether the door 30 reaches the risk area start position P4 by using the sub-sensor 363 disposed in the rear of the rope connector 382.

However, the distance between the sub-sensor 363 and the rope connector 382 may have deviation for each product by the design tolerance and the manufacturing tolerance.

In order to compensate for the distance deviation, the rod part 3633*b* of the pivot lever 3633 can be designed to generate elastic deformation at least partially in a state where it presses the push button 3632*c* of the micro switch 3632.

For example, if the distance between the sub-sensor 363 and the rope connector 382 becomes furthest by the design tolerance and the manufacturing tolerance, the rod part 3633*b* can be designed to elastically change its form, and thus the distance deviation can be effectively compensated for.

The connection part 3633*b*3 can correspond to the configuration for the elastic change of the form to be effectively generated, and the elastic change of the form can be provided to be generated by the connection part 3633*b*3.

However, in accordance with the opening and closing of the door 30, the elastic change of the form may occur repeatedly.

In order to prevent fatigue failure from occurring by the elastic change of the form that occurs repeatedly, it is required that the stress occurring during the elastic change of the form is not concentrated on any specific region.

In order to prevent such a stress concentration phenomenon and to disperse the stress, as illustrated in FIG. 13, a radius of curvature of the curvedly provided connection part 3633*b*3 can be constant, but can be provided to be greater than the radius of curvature of the above-described hook-shaped part 3633*b*2.

Further, if the thickness and the width of the connection part 3633*b*3 show a sharp difference in the relationship between the linear extension part 3633*b*1 and the hook-shaped part 3633*b*2, the stress is likely going to be concentrated in the position where the thickness and the width are changed sharply.

Accordingly, the thickness t of the linear extension part 3633*b*1, the thickness t of the hook-shaped part 3633*b*2, and the thickness t of the connection part 3633*b*3 in a direction that is vertical to the length direction of the rod part 3633*b* can be maintained constantly as proceeding in the length direction of the rod part 3633*b*, and can be equally configured.

In the same manner, the thickness t of the linear extension part 3633*b*1, the thickness t of the hook-shaped part 3633*b*2, and the thickness t of the connection part 3633*b*3 in a direction that is parallel to the lever shaft 3631*g* that becomes the rotation axis of the cylindrical base part 3633*a* can be maintained constantly as proceeding in the length direction of the rod part 3633*b*, and can be equally configured.

Figure 17:
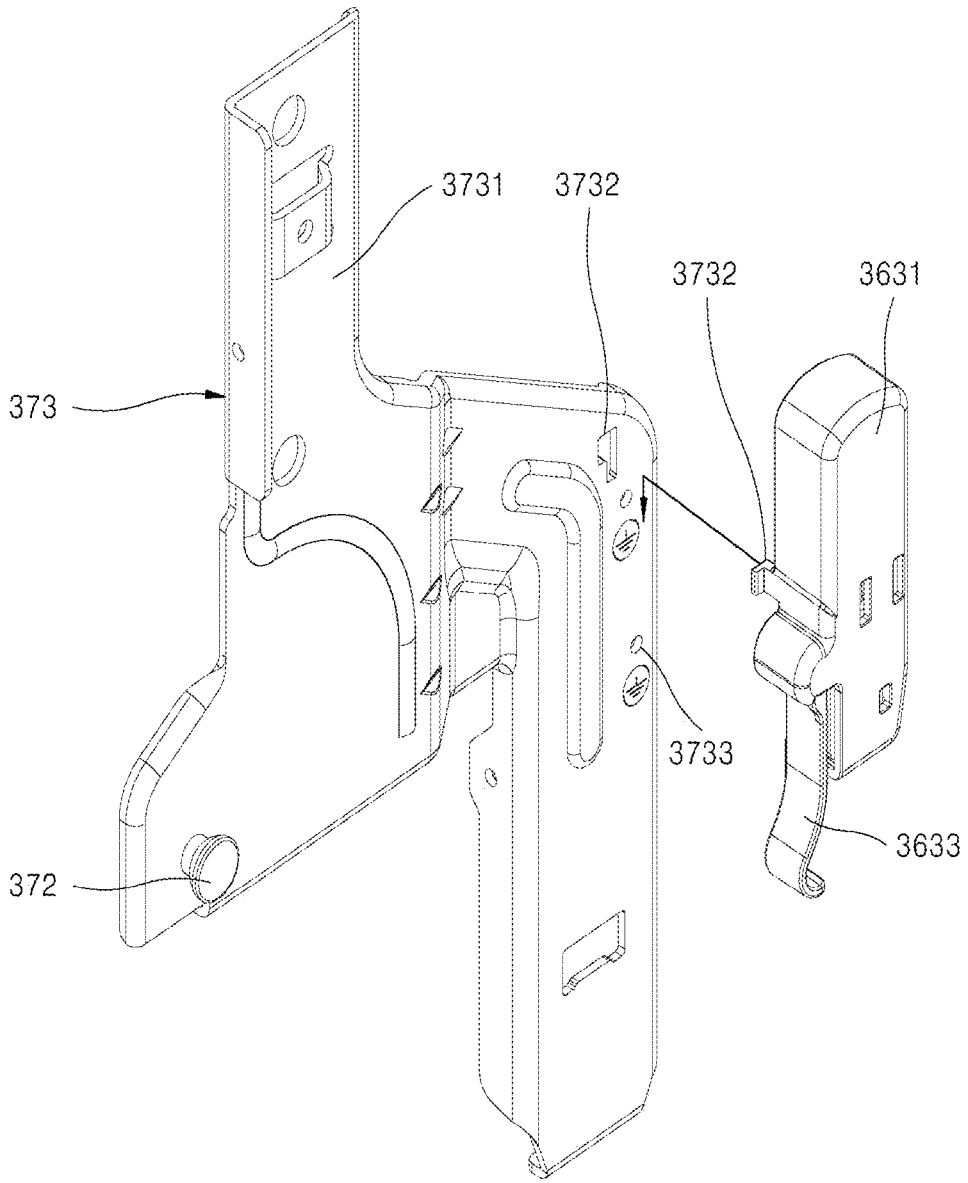
FIG. 17 is a diagram illustrating a side perspective view where the sub-sensor is mounted on a supporter bracket.

Hereinafter, referring to FIGS. 17 and 18, an assembly process of the sub-sensor 363 will be described.

As described above, the sub-sensor 363 can be coupled to the supporter bracket 373 constituting the door support part 37, and as a coupling means, a fastening tap 3631*c* and a lock tap 3631*h*, on which screw holes 3631*d* are provided, can be provided on the sensor housing 3631 of the sub-sensor 363.

In order to attach and couple the sub-sensor 363 to the supporter bracket 373, the lock tap 3631*h* can be inserted into an upper hole 3732*a* of the lock hole 3732.

Figure 18:
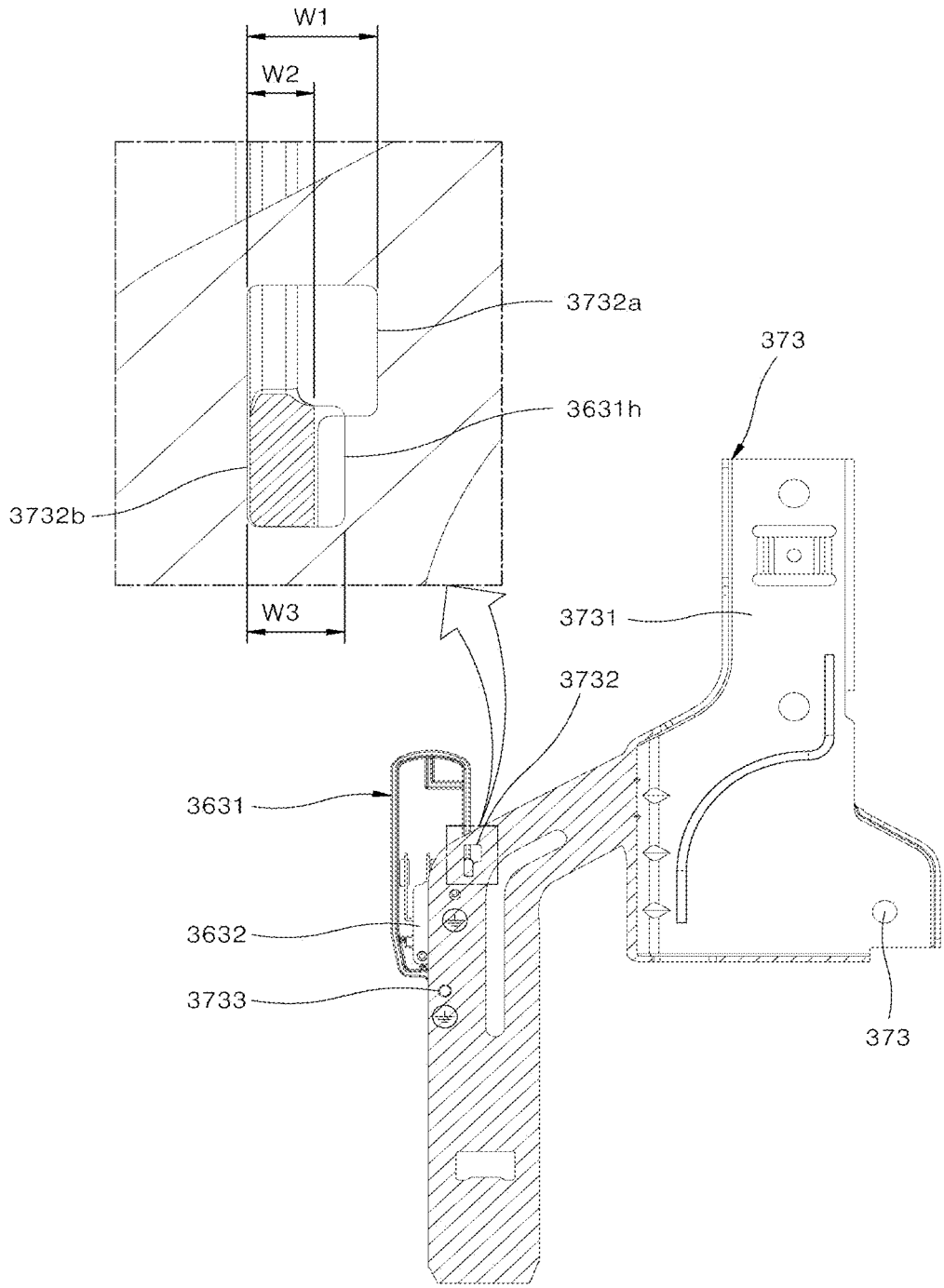
FIG. 18 is a diagram illustrating a cross-sectional view and a partially enlarged view of a state where the sub-sensor is mounted on the supporter bracket.

As illustrated in FIG. 18, the horizontal-direction width W1 and the vertical-direction width of the upper hole 3732*a* can be provided to be greater than the horizontal-direction width W3 and the vertical-direction width of the lock tap 3631*h*, respectively. Through this, the lock tap 3631*h* can easily pass through the upper hole 3732*a*.

If the lock tap 3631*h* passes through the upper hole 3732*a*, the sensor housing 3631 can be entirely moved toward the lower hole 3732*b* in a downward direction.

The horizontal-direction width W2 of the lower hole 3732*b* can be provided to be less than the horizontal-direction width W3 of the lock tap 3631*h*.

Accordingly, if the lock tap 3631*h* is maximally moved in the downward direction (D direction), the lock tap 3631*h* can be locked in the lower hole 3732*b*, and thus movement of the lock tap 3631*h* in a direction in which the lock tap gets far away from the supporter bracket 373 may not be possible.

As described above, the assembly of the sub-sensor 363 can be completed by fastening the fastening tap 3631*c* of the sensor housing 3631 to the screw hole 3733 of the supporter bracket 373 through a fastening means, such as a screw bolt, in a state where the lock tap 3631*h* is locked in the lower hole 3732*b*.

Accordingly, since the sub-sensor 363 can be effectively assembled and coupled to the supporter bracket 373 using only one screw bolt, the manufacturing time and the manufacturing cost can be saved.

Hereinafter, referring to FIG. 19, the configuration of a controller 100 of a dish washer 1 will be described.

Figure 19:
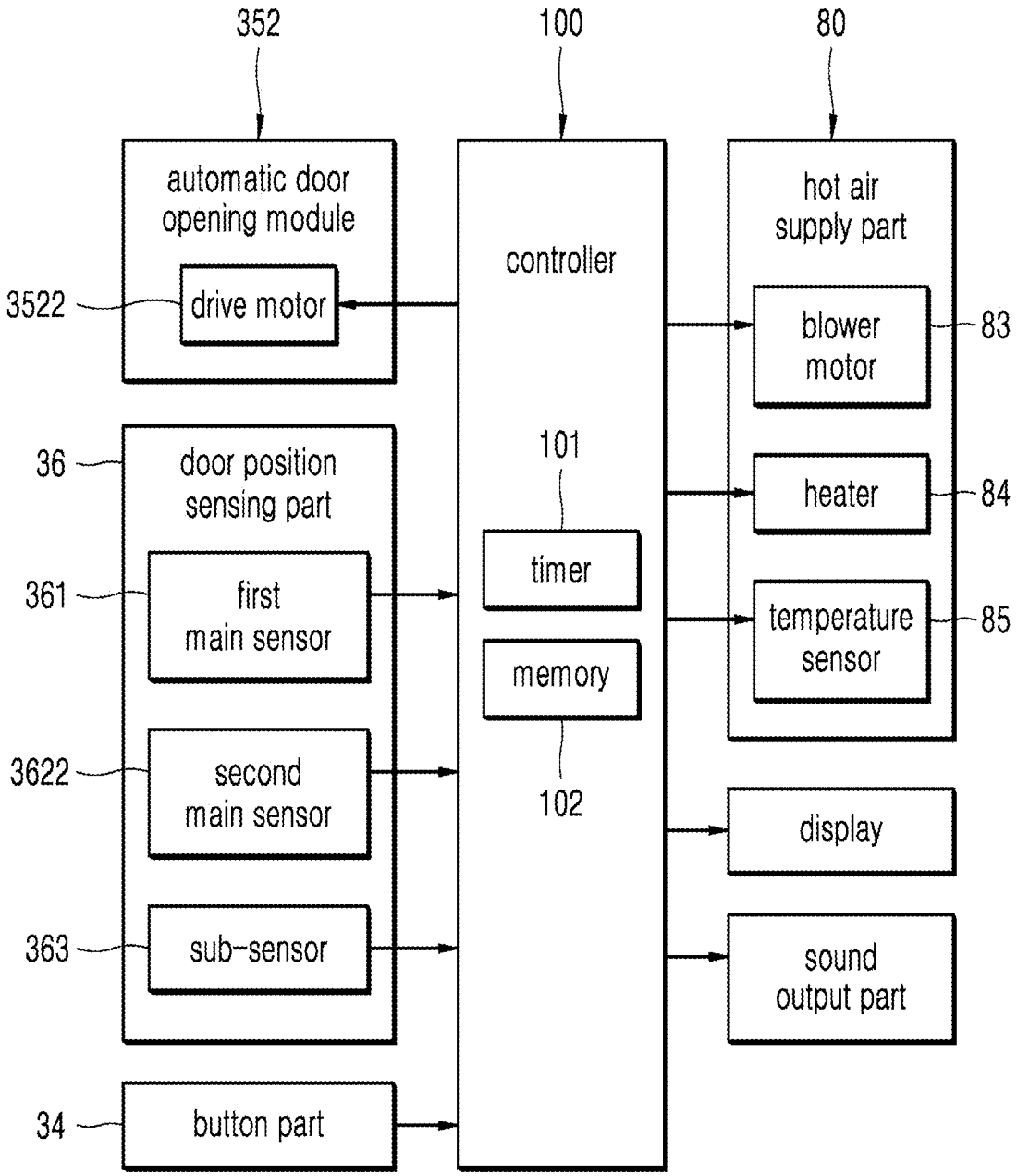
FIG. 19 is a functional block diagram explaining a controller provided in an example of a dish washer.

As illustrated in FIG. 19, the dish washer 1 can include the controller 100 for controlling respective functional configurations.

The controller 100 can be provided in various types, such as microcontroller, a microcomputer, or a microprocessor.

The controller 100 can be electrically connected to a power conversion part. The power input from an external power supply can be converted through the power conversion part, and can be supplied to the controller 100, the automatic door opening module 352, the display 33, a sound output part, the water supply pump, and the dry air supply part 80.

Further, the controller 100 can be individually and electrically connected to the first main sensor 361, the second main sensor 362, and the sub-sensor 363, respectively, which constitute the door position sensing part 36.

Through the first main sensor 361, the second main sensor 362, and the sub-sensor 363 being individually connected to the controller 100, the controller 100 can monitor the current position of door 30. For example, the controller 100 can sense whether the door 30 is in the closing position P1 or the door 30 moves from the closing position P1 through reception of output signals of the first main sensor 361 and the second main sensor 362, and can sense whether the position of the door 30 belongs to the above-described safety area A3 or belongs to the risk area A4 through movement of the safety area A3 by receiving an output signal of the sub-sensor 363.

Further, the controller 100 can be electrically connected to the button part 34 for inputting user's operation. The button part 34 can include a power button and a selection button. Through the button part 34, the controller 100 can receive a user's control command signal, that is, a power-ON signal or a process selection signal.

Further, the controller 100 can be electrically connected to a memory 102 and a timer 101. The controller 100 can call a driving condition and a time condition by processes being pre-stored in the memory 102, and using this, can generate a control signal for controlling operations of the automatic door opening module 352 and the dry air supply part 80. Further, the controller 100 can calculate an elapsed time for each process by using the timer 101, and can determine whether each process is completed through comparison of the elapsed time with the pre-stored time condition for each process. In some implementations, the time condition for each process can include an overall dry processing time, the high-temperature dry time for which the high-temperature dry air is supplied, and the low-temperature dry time for which the low-temperature dry air is supplied.

Further, the controller 100 can be electrically connected to the drive motor 3522 of the automatic door opening module 352. During the drying process, the controller 100 can control the door 30 to be opened at least partially by making the door 30 to move from the closing position P1 through supply of the power to the drive motor 3522 before operating the dry air supply part 80.

Further, the controller 100 can be electrically connected to the blower motor 83, the heater 84, and the temperature sensor 86, which constitute the dry air supply part 80. As described above, if the door 30 moves from the closing position P1, and is opened at least partially, the controller 100 can control to supply the high-temperature dry air by simultaneously supplying the power to the blower motor 83 and the heater 84, or can control to supply the low-temperature dry air by blocking the power supply to the heater 84 and operating only the blower motor 83. During the process of supplying the high-temperature dry air, the controller 100 can sense whether the dry air having a proper temperature is supplied and whether overheat is generated through an output signal of the temperature sensor 86.

Further, the controller 100 can be electrically connected to the display 33 and the sound output part. The controller 100 can control the display 33 to visually display information regarding the operation state of the dish washer 1, the operation time, and whether cooking is completed, and can control the sound output part, such as the above-described buzzer or the speaker, to output the operation state of the dish washer 1 or an alarm message through voice or sound. In some implementations, information provided through the display 33 and the sound output part can include information regarding a risk warning for the high-temperature dry air depending on the manual door opening during supplying of the high-temperature dry air, not working of the dry air supply part 80 depending on the door closed state, and information regarding operation completion of the dry air supply part 80.

Hereinafter, referring to FIGS. 20, 21, 22, and 23, a control method of a dish washer 1 will be described.

Figure 20:
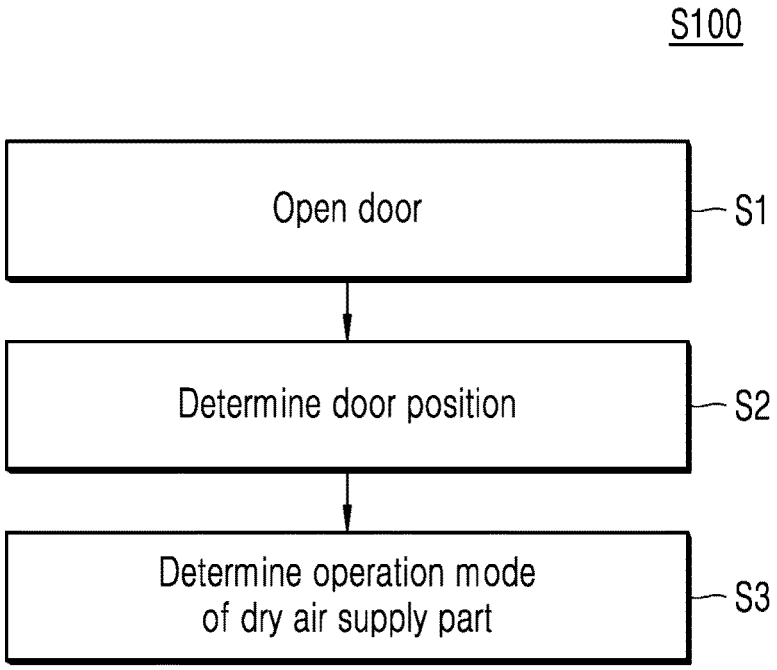
FIGS. 20, 21, 22, and 23 are flowcharts for explaining a dish washer control method.

First, referring to FIG. 20, the control method of the dish washer 1 can include opening the door 30, and determining the current position of the door 30 after opening the door 30 (S1 and S2).

As described above, the position of the door 30 can be sensed by the first main sensor 361, the second main sensor 362, and the sub-sensor 363, and the controller 100 can determine the position of the door 30 through the output signals of the first main sensor 361, the second main sensor 362, and the sub-sensor 363.

If the position of the door 30 is determined through the output signals of the first main sensor 361, the second main sensor 362, and the sub-sensor 363, the controller 100 can determine the operation mode of the dry air supply part 80 based on the determined position of the door 30 (S3).

Here, the operation mode of the dry air supply part 80 can include a high-temperature dry air supply mode in which both the heater 84 and the blower motor 83 operate, a low-temperature dry air supply mode in which the blower motor 83 operates, but the operation of the heater 84 is stopped, and a dry air supply stop mode in which the operations of the heater 84 and the blower motor 83 are stopped or interrupted.

Figure 22:
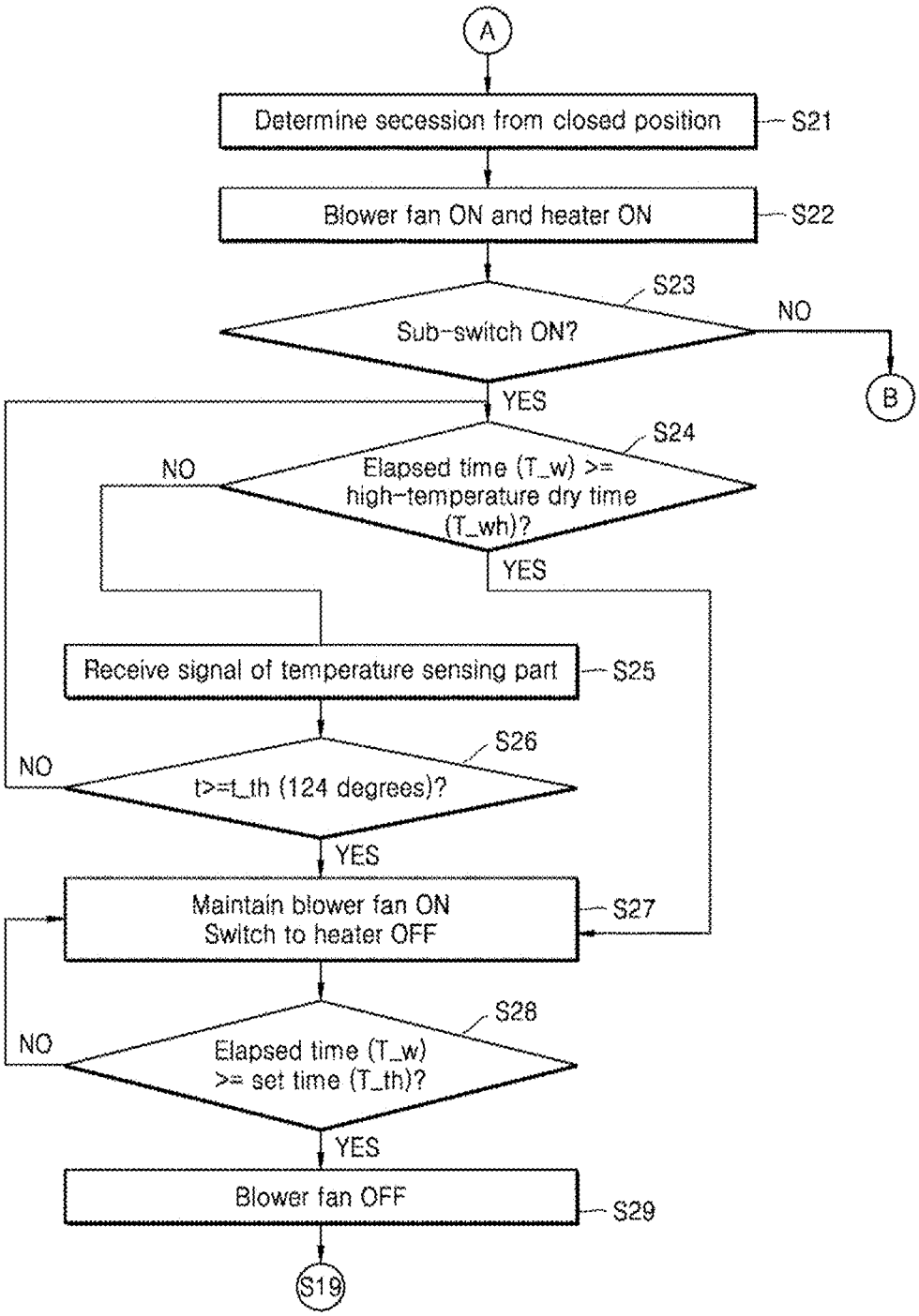
Figure 23:
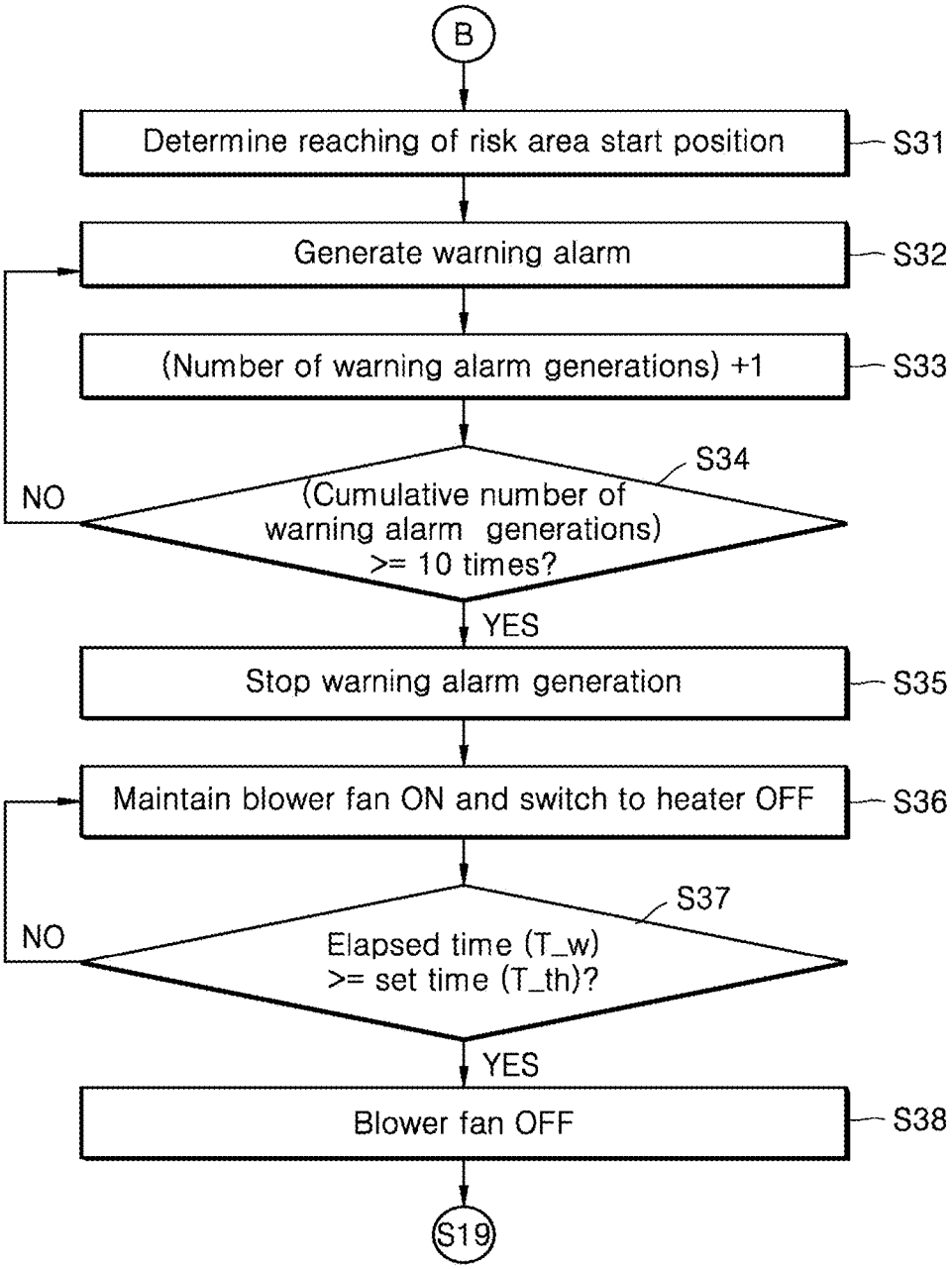

These processes will be described in detail with reference to FIGS. 21, 22, and 23 as follows.

Figure 21:
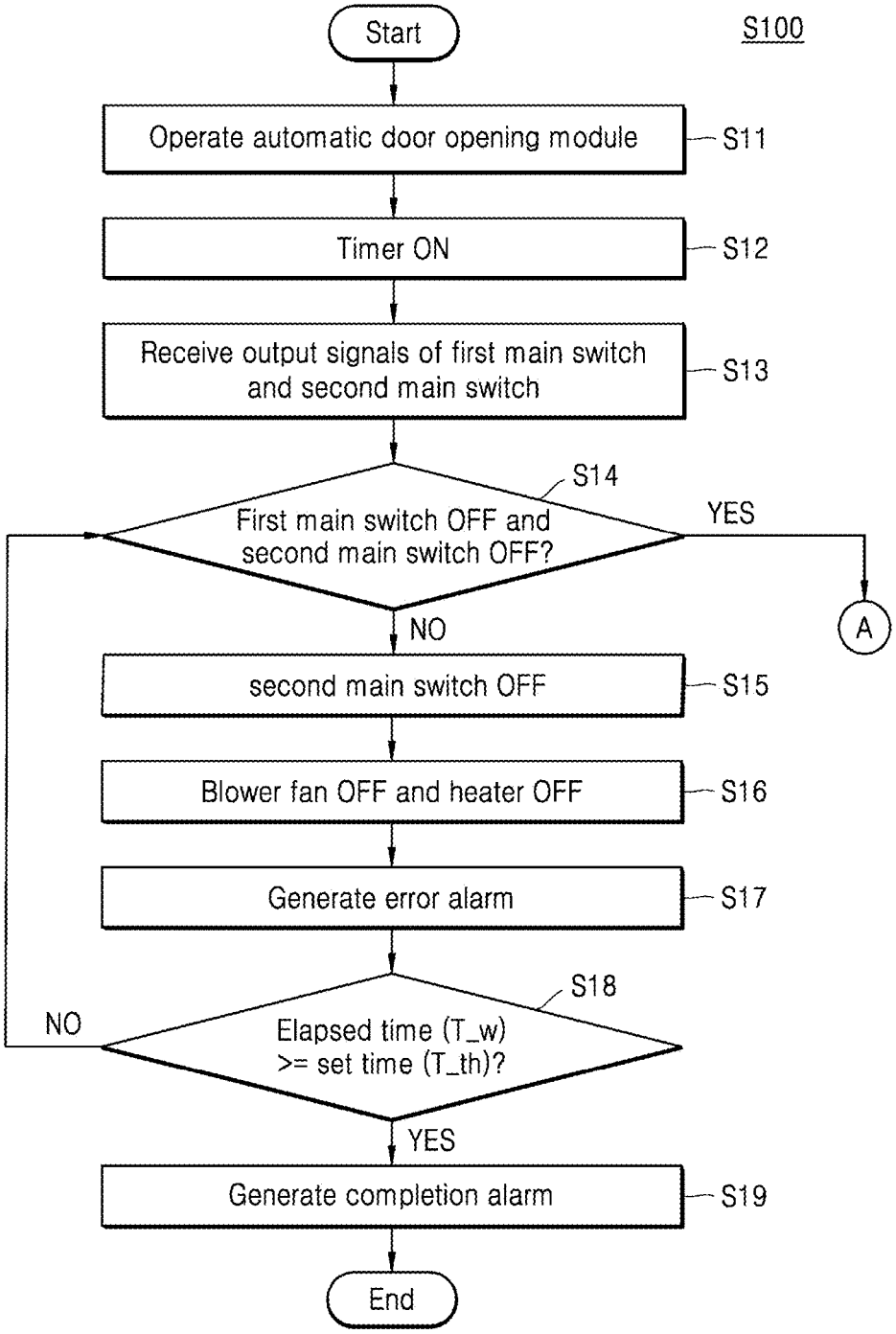

First, as illustrated in FIG. 21, to start the hot-air drying process for the object to be washed, the controller 100 can operate the automatic door opening module 352 by supplying the power to the drive motor 3522 (S11).

If the drive motor 3522 of the automatic door opening module 352 operates, the push rod 3524 of the automatic door opening module 352 can start movement to push out the rear surface of the door 30, and thus the door 30 moves from the closing position P1. For example, the closed state of the door 30 can be released, and the front of the tub 20 can start opening.

If the automatic door opening module 352 starts its operation, the controller 100 can operate the timer 101 (S12). The time when the timer 101 starts its operation becomes the time when the drying process starts, and the controller 100 can temporarily store the operation start time of the timer 101 in the memory 102. In some implementations, based on the elapsed time being measured based on the operation start time, the controller 100 can determine whether to stop the drying process, or determine whether to switch or interrupt the dry air supply.

Next, If the timer 101 starts its operation, the controller 100 can receive the output signals of the first main sensor 361 and the second main sensor 362 (S13).

As described above, the output signals of the first main sensor 361 and the second main sensor 362 can include an ON signal generated when the door 30 is in the closing position P1, and an OFF signal generated when the door 30 secedes from the closing position P1.

Next, the controller 100 can determine whether the received output signals of the first main sensor 361 and the second main sensor 362 are ON or OFF signals (S14).

If at least one of the output signals of the first main sensor 361 or the second main sensor 362 is an ON signal as the result of the determination in step S14, the controller 100 can determine that the door 30 is currently in the state of the closing position P1, and does not move from the closing position P1, and thus determines that the door 30 is in the closed state (S15).

For example, if it is determined that any one of the output signals of the first main sensor 361 or the second main sensor 362 includes an ON signal, the controller 100 can determine that the door 30 is in the state where it is not normally opened by the automatic door opening module 352.

In some implementations, the state where the door 30 is not normally opened can be caused by, for example, an internal factor, such as the state where the door latch is not normally released or the state where the automatic door opening module 352 is not normally operated, or an external factor, such as the state where the door 30 is unable to be opened due to an external force being applied to the door 30 or an external obstacle.

In step S15, if it is determined that the door 30 is in the closed state, the controller 100 may not supply the power to the blower fan 82 and the heater 84 of the dry air supply part 80, and can maintain the blower fan 82 and the heater 84 in a non-operation state (S16).

For example, since it is determined that the door 30 is currently in the closed state, the controller 100 can maintain the dry air supply step mode without starting the operations of the blower fan 82 and the heater 84 for generating the dry air. Through this, the moisture condensation phenomenon, which may occur when the dry air is supplied in case that the door 30 is in the closed state, can be effectively blocked.

As described above, after the door 30 is determined to be in the closed state, and the blower fan 82 and the heater 84 can be maintained in the non-operation state, the controller 100 can control the sound output part or the display 33 to generate an error alarm by transmitting a control signal thereto (S17).

In some implementations, the error alarm can include an acoustic error alarm generated through the sound output part and a visual error alarm generated through the display 33.

The acoustic error alarm or the visual error alarm can include information regarding the door open failure or not working of the dry air supply part 80 according to the door open failure.

The user may intuitively identify the state where the door 30 is not normally opened and the state where the drying process through the dry air supply is unable to be performed through the error alarm. Further, through the error alarm, the user who has recognized the error alarm may be induced to take proper action.

In some implementations, even after the error alarm is generated, user's absence or an error alarm unrecognizable state may occur.

In such a situation where the user's action is unable to be expected, the drying process may not be normally performed.

Accordingly, after the error alarm is generated in step S17, the controller 100 can determine whether the current elapsed time exceeds a predetermined set time through the timer 101 (S18).

In some implementations, the predetermined set time can be a scheduled time as a drying process performing time.

The set time can be the time pre-selected and adjusted by the user, or the time preconfigured and stored in the memory 102. For example, if there is not the user's selection and adjustment, the set time may be, for example, 500 seconds.

In step S18, if it is determined that the elapsed time is equal to or greater than the set time, the controller 100 can determine that the scheduled drying process time has elapsed, stop the drying process, and generate the drying process completion alarm by transmitting the control signal to the sound output part or the display 33 (S19).

In some implementations, the completion alarm can include an acoustic completion alarm generated through the sound output part or a visual completion alarm generated through the display 33.

The acoustic completion alarm or the visual completion alarm can include information regarding the not working of the dry air supply part 80 or the operation completion of the dry air supply part 80.

In some implementations, if it is determined that the elapsed time is less than the set time in step S18, the controller 100 can determine that the scheduled drying process time has not yet elapsed, and proceed with the above-described step S14 to determine whether the door 30 is opened or moves from the closed state by the user's action.

In some implementations, if it is determined that the output signals of the first main sensor 361 and the second main sensor 362 are ON signals in all as the result of the determination in step S14, the controller 100 can determine that the door 30 is normally opened, and normally moves from the closing position P1, and thus the controller 100 can determine that the door 30 is in the position where the door 30 normally moves from the closing position P1 (S21).

As described above, since the door 30 is normally moving from the closing position P1, and is in a normally opened state, the controller 110 can start the operation of the dry air supply part 80 in a high-temperature dry air supply mode in which the high-temperature dry air is supplied (S22).

If the operations of the blower fan 82 and the heater 84 start, the high-temperature dry air generated through the blower fan 82 and the heater 84 can be supplied into the tub 20 through the blower duct 85 of the dry air supply part 80.

As described above, by controlling the high-temperature dry air to be immediately supplied after the opening of the door 30 starts, the temperature inside the tub 20 can be increased in an entirely short time before the door 30 reaches the middle stop position P3. Accordingly, the drying efficiency of the object to be washed can be improved as compared with a case where the supply of the high-temperature dry air starts after the door 30 reaches the middle stop position P3 through completion of the automatic opening of the door 30.

As described above, while it is determined that the door 30 moves from the closing position P1, and the supply of the high-temperature dry air continues, the controller 100 can receive an output signal from the sub-switch, and determine whether the output signal of the sub-switch is an ON signal or an OFF signal (S23).

In a similar manner as the first main sensor 361 and the second main sensor 362, the output signal of the sub-switch can include an ON signal generated when the door 30 is between the closing position P1 and the risk area start position P4, and an OFF signal generated when the door 30 reaches the risk area start position P4.

In some implementations, if it is determined that the output signal of the sub-switch is an ON signal, the controller 100 can determine that the door 30 is currently in the position suitable to supply the high-temperature dry air, that is, in the safety area A3 between the closing position P1 and the risk area start position P4, and continuously proceed with the supply of the high-temperature dry air without interruption.

Next, while the supply of the high-temperature dry air continues, the controller 100 can determine whether the current elapsed time exceeds a specific high-temperature drying time through the timer 101 (S24).

In some implementations, the specific high-temperature drying time can be the time that is a part of the entire drying process proceeding time, and in the same manner as the set time, it can be the time pre-selected and adjusted by the user, or the time preconfigured and stored in the memory 102. For example, if there is not the user's selection and adjustment, the high-temperature drying time can be, for example, 300 seconds.

In step S24, if it is determined that the elapsed time is equal to or greater than the high-temperature drying time, the controller 100 can determine that the scheduled high-temperature drying process time has elapsed, and stop the power supply to the heater 84 to stop the supply of the high-temperature dry air (S27).

In some implementations, the high-temperature drying through the supply of the high-temperature dry air is stopped, but in order to continue the low-temperature drying, the controller 100 can control to maintain the power supply to the blower fan 82. For example, the operation of the dry air supply part 80 can be switched from the high-temperature dry air supply mode to the low-temperature dry air supply mode.

Through this, by supplying the low-temperature dry air for a specific time before the drying process is completed, the temperature of the object to be washed can be lowered to a safe level, and if the drying process is completed, the user can safely discharge the object to be washed from the tub 20 by fully opening the door 30 immediately.

In some implementations, in step S24, if it is determined that the elapsed time is less than the high-temperature drying time, the controller 100 can determine that that the high-temperature drying time has not yet elapsed, and continue the supply of the high-temperature dry air.

However, in order to identify whether the supplied high-temperature dry air is supplied in a proper temperature range, or whether overload occurs in the heater 84, the controller 100 can receive the output signal of the temperature sensing part during supplying of the high-temperature dry air (S25).

In some implementations, the output signal of the temperature sensing part can include an output signal of a thermistor 861, and the controller 100 can determine the temperature of the high-temperature dry air generated from the dry air supply part 80 or the temperature of the heater 84 based on the output signal of the thermistor 861.

If the output signal is received from the temperature sensing part, the controller 100 can determine whether the temperature of the high-temperature dry air exceeds a specific threshold temperature (S26).

The high-temperature dry air generated from the dry air supply part 80 can be designed to have a specific appropriate temperature range, and the appropriate temperature range can be, for example, 115° C. to 124° C.

In some implementations, the specific threshold temperature can be, for example, 124° C., and if it is determined that the current temperature of the high-temperature dry air is equal to or greater than 124° C., the controller 100 can determine that the overheat occurs, whereas otherwise, the controller 100 can determine that the dry air supply part 80 operates in the appropriate temperature range.

Accordingly, in step S26, if it is determined that the current temperature of the high-temperature dry air is equal to or greater than the threshold temperature, the controller 100 can determine that overheat occurs in the dry air supply part 80, and stop the power supply to the heater 84 (S26).

In some implementations, to lower the internal temperature of the tub 20 overheated by the overheated high-temperature dry air and the temperature of the dry air supply part 80, the controller 100 can maintain the power supply to the blower fan 82. For example, to lower the temperature of the object to be washed and the tub 20 to a safe level, the controller 100 can switch the operation of the dry air supply part 80 to the low-temperature dry air supply mode by operating the blower fan 82 in a state where the heater 84 is turned off.

In step S27, after the operation of the dry air supply part 80 is switched to the low-temperature dry air supply mode, the controller 100 can determine whether the current elapsed time exceeds the specific set time through the timer 101 (S28).

As described above, the specific set time can be the time scheduled as the drying process proceeding time.

In step S28, if it is determined that the elapsed time is equal to or greater than the set time, the controller 100 can determine that the scheduled drying process time has elapsed, stop the power supply to the blower fan 82, and stop the operation of the dry air supply part 80 (S28). For example, the operation of the dry air supply part 80 can be switched to a dry air supply stop mode.

In step S28, if the operation of the blower fan 82 is stopped, the controller 100 can proceed with the above-described step S19, and generate a drying process completion alarm.

In some implementations, if it is determined that the elapsed time is less than the set time in step S28, the controller 100 can proceed with the above-described step S27, maintain the low-temperature dry air supply mode, and then repeatedly proceed with the steps.

In some implementations, if it is determined that the output signal of the sub-switch is an OFF signal in step S23, the controller 100 can determine that the door 30 currently moves from the safety area A3, and reaches the risk area start position P4 (S31).

As described above, if it is determined that the door 30 has reached the risk area start position P4, the controller 100 can control the sound output part or the display 33 to generate a warning alarm by transmitting the control signal thereto (S32).

In some implementations, the warning alarm can include an acoustic warning alarm generated through the sound output part and a visual warning alarm generated through the display 33.

The acoustic warning alarm or the visual warning alarm can include information regarding a risk warning for the high-temperature dry air in accordance with the manual opening of the door 30.

Through the warning alarm, the user may intuitively identify the state where the door 30 is manually opened in a state where the high-temperature dry air is currently supplied, and thus the user may be exposed to the high-temperature dry air.

Since such manual opening may occur in accordance with a user's intention or regardless of the user's intention, the user may be at risk of being exposed to the high-temperature dry air by the manual opening of the door 30.

Accordingly, through the warning alarm, the user may be induced to take action, such as to stop the manual opening operation or to return the door 30 to the safety area A3. Through this, user's scald due to the high-temperature dry air can be prevented.

However, once warning alarm may cause the user to be unable to recognize the high-temperature dry air risk state.

Accordingly, in order to enhance the user's recognition and recognition possibility, the controller 100 can control to repeatedly generate the warning alarm, and the number of times of warning alarm generation is accumulated and stored in the memory 102 (S33).

Further, the controller 100 can determine whether the accumulated number of times of warning alarm generation exceeds a specific number of times (S34).

In some implementations, the specific number of times can be, for example, 10 times.

After 10 times warning alarm generation, the controller 100 can stop the warning alarm generation, and stop the power supply to the heater 84 (S35 and S36).

In some implementations, in a similar manner to that as described above, the controller 100 can control the operation of the dry air supply part 80 to be switched to the low-temperature dry air supply mode by blocking the power supply to the heater 84 and maintaining the power supply to the blower fan 82.

This is to reduce the dry efficiency degradation that occurs due to the supply of the high-temperature dry air in a state where the door 30 is excessively opened, and to lower the temperatures of the inside of the tub 20 and the object to be washed by supplying the low-temperature dry air in a state where the door 30 moves from the middle stop position P3 and is manually opened.

Next, if the operation is switched to the low-temperature dry air supply mode in step S36, the controller 100 can determine whether the current elapsed time exceeds the specific set time through the timer 101 (S37).

As described above, the specific set time can be the time scheduled as the drying process proceeding time.

If it is determined that the elapsed time is equal to or greater than the set time in step S37, the controller 100 can determine that the scheduled drying process time has elapsed, stop the power supply to the blower fan 82, and stop the operation of the dry air supply part 80 (S38).

If the operation of the blower fan 82 is stopped in step S37, the controller 100 can proceed with the above-described step S20, and generate the drying process completion alarm.

From the foregoing, although the disclosure has been described with reference to the exemplified drawings, it is obvious that the disclosure is not limited by the embodiments and the drawings disclosed in the specification, but various modifications will be made by those of ordinary skill in the art to which the disclosure pertains within the scope of the technical idea of the disclosure. Further, even if the operational effects according to the configuration of the disclosure have not been explicitly described or explained while explaining the embodiment of the disclosure, it is apparent that effects that can be predicted by the corresponding configuration should also be accepted.

The invention claimed is:

1. A dish washer comprising:

a tub configured to receive an object to be washed and providing a washing space having an opening at a front side of the tub;

a door configured to rotate relative to the tub between (i) a closing position that closes the opening of the washing space and (ii) a full opening position that exposes an entirety of the opening of the washing space;

a door position sensor configured to sense a position of the door;

a dry air supply configured to selectively generate a first dry air or a second dry air and supply the first dry air or the second dry air into the tub, the first dry air having a higher air temperature than the second dry air; and a controller configured to determine, based on the position of the door sensed by the door position sensor, whether to supply the first dry air or the second dry air.

2. The dish washer of claim 1, wherein the dry air supply comprises a heater configured to heat a dry air flow, and wherein the controller is configured to control the heater to determine whether to supply the first dry air or the second dry air.

3. The dish washer of claim 2, wherein the controller is configured to:

based on a determination to supply the first dry air, supply power to the heater, and based on a determination to supply the second dry air, block the power from being supplied to the heater.

4. The dish washer of claim 1, further comprising an automatic door opener configured to move the door from the closing position to a middle stop position set between the closing position and the full opening position to expose a part of the opening of the washing space, wherein the controller is configured to operate the automatic door opener before supplying the first dry air or the second dry air.

5. The dish washer of claim 4, further comprising an elastic member configured to provide a restoring force to rotate the door toward the closing position, wherein the middle stop position is a position at which a rotating force generated by a weight of the door and an elastic force of the elastic member are equal to each other.

6. The dish washer of claim 4, wherein the controller is configured to:

receive an output signal from the door position sensor and determine the position of the door through the received output signal after operating the automatic door opener, and start supplying the first dry air by supplying power to the dry air supply based on a determination that the door moves from the closing position and the part of the washing space is exposed.

7. The dish washer of claim 6, wherein the dry air supply comprises:

a heater;

a blower fan configured to generate a dry air flow to be supplied into the tub; and a blower motor configured to generate a rotational force of the blower fan, wherein the controller is configured to:

based on a determination to supply the first dry air, supply the power to the blower fan and the heater, and based on a determination to supply the second dry air, supply the power to the blower fan and block the power from being supplied to the heater.

8. The dish washer of claim 6, wherein the controller is configured to determine whether the door reaches a predetermined risk area start position set between the middle stop position and the full opening position based on the output signal of the door position sensor after supplying the first dry air.

9. The dish washer of claim 8, wherein the controller comprises a timer configured to measure an elapsed time after the automatic door opener is operated, wherein the controller is configured to, based on a determination that the door does not reach the predetermined risk area start position, determine whether the elapsed time exceeds a predefined first temperature dry time.

10. The dish washer of claim 9, wherein the controller is configured to, based on a determination that the elapsed time is greater than or equal to the predefined first temperature dry time, switch an operation of the dry air supply from supplying the first dry air to supplying the second dry air.

11. The dish washer of claim 10, wherein the controller is configured to, after the operation of the dry air supply is switched, determine whether the elapsed time exceeds a predefined set time.

12. The dish washer of claim 11, wherein the controller is configured to, based on a determination that the elapsed time is greater than or equal to the predefined set time, stop the operation of the dry air supply.

13. The dish washer of claim 9, wherein the dry air supply further comprises a temperature sensor configured to measure a temperature of the dry air, wherein the controller is configured to, based on a determination that the elapsed time is less than the predefined first temperature dry time, (i) receive the output signal from the temperature sensor and (ii) determine whether the temperature of the dry air in the received output signal exceeds a predefined temperature.

14. The dish washer of claim 13, wherein the controller is configured to, based on a determination that the temperature of the dry air is greater than or equal to the predefined temperature, switch the operation of the dry air supply from supplying the first dry air to supplying the second dry air.

15. The dish washer of claim 8, further comprising at least one of a speaker configured to generate a sound alarm or a display configured to generate a visual alarm, wherein the controller is configured to, based on a determination that the door reaches the predetermined risk area start position, generate an acoustic or visual warning alarm through the speaker or the display, and wherein the warning alarm includes information regarding a risk from the first dry air.

16. The dish washer of claim 15, wherein, after the warning alarm is generated, the controller is configured to:

update and store a number of times of the warning alarm is generated, and determine whether the updated number exceeds a predefined number.

17. The dish washer of claim 16, wherein the controller is configured to, based on a determination that the updated number exceeds the predefined number, (i) stop an additional warning alarm generation and (ii) switch the operation of the dry air supply from supplying the first dry air to supplying the second dry air, after the additional warning alarm generation is stopped, wherein the controller comprises a timer configured to measure an elapsed time after the automatic door opener is operated, wherein the controller is configured to:

determine whether the elapsed time exceeds a predefined set time after switching the operation of the dry air supply, and stop, based on a determination that the elapsed time is greater than or equal to the predefined set time, the operation of the dry air supply.

18. The dish washer of claim 6, wherein the controller is configured to, based on a determination that the door does not move from the closing position, maintain a non-operation state of the dry air supply.

19. The dish washer of claim 18, further comprising at least one of a speaker configured to generate a sound alarm or a display configured to generate a visual alarm, wherein the controller is configured to, based on a determination that the door does not move from the closing position, generate an acoustic or visual error alarm through the speaker or the display, and wherein the error alarm includes information regarding the dry air supply being inoperable.

20. The dish washer of claim 19, wherein the controller comprises a timer configured to measure an elapsed time after the automatic door opener is operated, wherein the controller is configured to determine whether the elapsed time exceeds a predefined set time after the error alarm is generated, wherein the controller is configured to, based on a determination that the elapsed time is greater than or equal to the predefined set time, generate acoustic or visual completion alarm through the speaker or the display, and wherein the completion alarm includes information regarding operation status of the dry air supply.

* * * * *